US007198261B2

(12) United States Patent
Matsumoto et al.

(10) Patent No.: US 7,198,261 B2
(45) Date of Patent: Apr. 3, 2007

(54) SHEET STACKING APPARATUS

(75) Inventors: Yuzo Matsumoto, Ibaraki (JP); Hiromichi Tsujino, Ibaraki (JP); Mitsushige Murata, Chiba (JP); Takako Hanada, Ibaraki (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 11/193,919

(22) Filed: Jul. 29, 2005

(65) Prior Publication Data

US 2005/0263957 A1 Dec. 1, 2005

Related U.S. Application Data

(63) Continuation of application No. 10/793,119, filed on Mar. 4, 2004, now Pat. No. 6,962,331.

(30) Foreign Application Priority Data

Mar. 6, 2003 (JP) ..... 2003-060479

(51) Int. Cl.
*B65H 33/04* (2006.01)

(52) U.S. Cl. ..... 270/58.09; 270/58.11; 270/58.12; 270/58.16; 270/58.27

(58) Field of Classification Search ..... 270/58.12, 270/58.16, 58.17, 58.27, 58.08, 58.09, 58.11, 270/58.14; 399/410
See application file for complete search history.

(56) References Cited

U.S. PATENT DOCUMENTS 5,288,062 A 2/1994 Rizzolo et al.
5,462,265 A 10/1995 Mandel et al.
6,427,997 B1 8/2002 Hirota et al.
6,574,011 B1 6/2003 Sato et al.
6,575,446 B2 * 6/2003 Wakabayashi et al. ... 270/58.07
6,619,648 B2 9/2003 Sasamoto et al.
6,666,444 B1 12/2003 Paoli

FOREIGN PATENT DOCUMENTS

JP 11-171396 A 6/1999
JP 11286353 A 10/1999
JP 2000-355455 A 12/2000
JP 2003-118923 A 4/2003

* cited by examiner

*Primary Examiner*—David H. Bollinger
(74) *Attorney, Agent, or Firm*—Rossi, Kimms & McDowell LLP

(57) ABSTRACT

A sheet stacking apparatus which is capable of reliably sandwiching or catching sheets, and also capable of providing control so as to ensure reliable conveyance of succeeding sheets during the catching operation. A stack tray is provided downstream of a processing tray that stacks sheets. A position on the stacking surface of the stack tray at which the leading end of a sheet having its trailing end passing a discharging section, which discharges sheets toward the processing tray, contacts the stacking surface is lower in level than the highest portion of the processing tray. A swinging arm that discharges the sheets stacked on the processing tray to the stack tray is capable of selectively assuming a catching state in which a sheet discharged to the processing tray is caught by the swinging arm, and a non-catching state in which a sheet discharged to the processing tray is not caught by the swinging arm. The swinging arm is controlled to assume the non-catching state when the discharging section starts discharging a sheet, and switch to the catching state before the trailing end of the sheet discharged by the discharging section passes the swinging arm.

7 Claims, 26 Drawing Sheets

| MATERIAL | t | T | v | a | REMARKS |
|---|---|---|---|---|---|
| A | $t_1$ | $T_1$ | $v_1$ | $a_1$ | CATCHING IS POSSIBLE |
| B | $t_2$ | $T_1$ | $v_1$ | $a_1$ | CATCHING IS IMPOSSIBLE |
| | $t_2$ | $T_2$ | $v_2$ | $a_1$ | CATCHING IS POSSIBLE |
| | $t_2$ | $T_2$ | $v_1$ | $a_2$ | CATCHING IS POSSIBLE |
| | $t_3$ | $T_1$ | $v_1$ | $a_1$ | CATCHING IS POSSIBLE |

SHEET STACKING APPARATUS

This application is a continuation of application Ser. No. 10/793,119 filed Mar. 04, 2004, now U.S. Pat. No. 6,962, 331.

BACKGROUND OF THE INVENTION

1. Field of the Invention

The present invention relates to a sheet stacking apparatus that stacks sheets which have been conveyed.

2. Description of the Related Art

Conventionally, an image forming apparatus which has a sheet processing apparatus incorporated in a housing thereof has been proposed (Japanese Patent Application No. 2001-313041). An image forming apparatus of this type in which sheets are discharged inside the housing enables a large reduction in the space occupied by the sheet processing apparatus. FIG. 29 is a sectional view showing the construction of the conventional image forming apparatus of the type in which sheets are discharged inside the housing. In this image forming apparatus, a processing tray 1001 is mounted in an inclined fashion inside a sheet processing apparatus 1000. Sheets S on which images have been formed inside the main body of the image forming apparatus are temporarily stacked on the processing tray 1001 inside the sheet processing apparatus 1000, and the sheets are then subjected to post processing such as aligning and stapling on the processing tray 1001.

In the sheet processing apparatus 1000 in which the processing tray 1001 is mounted in an inclined fashion, it is intended that sheets discharged onto the processing tray 1001 slide along an inclined surface of the tray to move backward, and hence the sheets on the processing tray 1001 can be aligned in the sheet conveying direction by a simple return roller. Further, a sheet processing apparatus exists, in which a processing tray is mounted with a reduced angle of inclination thereof so that it is disposed on a substantially horizontal plane, in order to have an increased number of sheets stacked thereon. This sheet processing apparatus is capable of performing sheet discharge speed control such that sheets discharged from the image forming apparatus has a jumping amount thereof controlled to a substantially constant amount according to conditions of the sheets such as sheet size and sheet material.

Further, another sheet processing apparatus is known, which has a pair of discharging rollers composed of an upper roller and a lower roller provided at an sheet discharge outlet of a processing tray disposed substantially horizontally, to convey sheets discharged from the image forming apparatus (Japanese Laid-Open Patent Publication (Kokai) No. H11-171396). This sheet processing apparatus has a roller position changing means for displacing the upper roller selectively into an operating position in which the upper roller is placed in contact with the peripheral surface of the lower roller and into a receding position separate from the operating position, and a driving means for driving the upper roller to rotate forward or backward.

In this sheet processing apparatus, to convey sheets discharged from the image forming apparatus onto the processing tray, control is provided to set the upper roller into the operating position and drive the same to rotate backward. On the other hand, to convey a bundle of sheets subjected to post processing on the processing tray onto a stack tray, control is provided to set the upper roller into the operating position and drive the same to rotate forward.

Still another sheet processing apparatus is known, in which sheets with images formed thereon are conveyed and stacked on an intermediate stacker as a processing tray, followed by being subjected to post processing, and the post processed sheets are discharged onto and stacked on a stack tray (Japanese Laid-Open Patent Publication (Kokai) No. 2000-355455). This sheet processing apparatus is comprised of a pair of sheet discharging rollers composed of an upper sheet discharging roller and a lower sheet discharging roller which are rotatable forward and backward to sandwich or catch sheets on the intermediate stacker therebetween to convey and discharge them, a crimp means for swinging the upper sheet discharging roller selectively into urging contact with or separate from the lower sheet discharging roller, and a driving means for driving the sheet discharging rollers to selectively rotate forward or backward while activating the crimp means. In the sheet processing apparatus, the stack tray is disposed at a lateral side surface of the image forming apparatus in a manner inclined through approximately 30 degrees. A portion of the stacking surface of the stack tray at which the leading end of a sheet to be processed discharged onto the intermediate stacker by the sheet discharging rollers contacts the stacking surface of the stack tray is at a higher level than the highest portion of the intermediate stacker, and therefore the sheet to be processed discharged onto the intermediate stacker never drops down onto the stack tray due to its own gravity.

However, if the sheet processing apparatus is configured such that the stack tray is disposed at a location below an original reader and at an upper location inside the main body of the image forming apparatus, and with an angle of inclination smaller than that in the conventional configuration so as to secure a sufficient stacking capacity of the stack tray, the following problem arises. Therefore, it is difficult to obtain a sufficient stacking capacity of the stack tray when it is disposed at a location below the original reader and at an upper location inside the main body of the image forming apparatus.

That is, when the sheet processing apparatus conveys a sheet received from the image forming apparatus and discharges it onto the intermediate stacker through the stack tray, the sheet cannot move backward due to its own gravity on the substantially horizontal inclined surface of the stack tray and hence cannot drop onto the intermediate stacker. Therefore, if the discharging speed of the sheet is too high, the sheet can drop onto the stack tray without sliding down to the intermediate stacker. Consequently, the sheet cannot be properly sandwiched or caught between the upper and lower sheet discharging rollers by the upper sheet discharging roller being lowered toward the lower sheet discharging roller. On the other hand, if the discharging speed of the sheet is too low, the sheet discharging rollers which are relatively weak in driving force cannot completely discharge the sheet onto the intermediate stacker, so that the trailing end of the sheet remains on the sheet discharging rollers.

Further, when a bundle of sheets post processed on the processing tray is discharged in a bundle onto the stack tray while being sandwiched between the upper and lower rollers, if the timing in which the upper roller is lifted is delayed, there is a fear that the leading end of a succeeding sheet discharged onto the processing tray collides with the upper roller or a member that swings the upper roller.

Moreover, even if the discharging speed of sheets is controlled to a constant speed, the actual discharging speed can increase depending upon the material of an image-formed sheet, so that the sheet can jump excessively and cannot be properly sandwiched or caught.

In addition, to reliably sandwich sheets, the sheet stacking surface of the processing tray has to be large, leading to an increased size of the apparatus.

SUMMARY OF THE INVENTION

It is an object of the present invention to provide a sheet stacking apparatus which is capable of reliably sandwiching or catching sheets, and also capable of providing control so as to ensure reliable conveyance of succeeding sheets during the catching operation.

To attain the above object, in a first aspect of the present invention, there is provided a sheet stacking apparatus comprising a first sheet stacking device that stacks sheets, a first discharging device that discharges a sheet conveyed from an upstream side thereof toward the first sheet stacking device, a second sheet stacking device provided downstream of the first sheet stacking device, a leading end of a sheet laid on the second sheet stacking device is lower in level than a highest portion of a trailing end thereof laid on the first sheet stacking device when the trailing end of the sheet is discharged from the first discharging device, a second discharging device that discharges the sheets stacked on the first sheet stacking device to the second sheet stacking device, the second discharging device being capable of selectively assuming a catching state in which a sheet discharged to the first sheet stacking device is caught by the second discharging device, and a non-catching state in which a sheet discharged to the first sheet stacking device is not caught by the second discharging device, and a controller that controls the second discharging device to assume the non-catching state when the first discharging device starts discharging a sheet, and switch to the catching state before a trailing end of the sheet discharged by the first discharging device passes the second discharging device.

Preferably, the controller provides control to change at least one selected from the group consisting of a discharging speed of the first discharging device, swinging start timing of the second discharging device, a swinging speed of the second discharging device, and a swinging acceleration of the second discharging device.

More preferably, the second discharging device is swingable between a waiting position in which the second discharging device does not interfere with a sheet discharged by the first discharging device, and a catching position in which the second discharging device can catch the sheet discharged by the first discharging device.

Further preferably, wherein the controller comprises a comparison device that compares a swinging time period over which the second discharging device swings from the waiting position to the catching position and a sliding time period of a trailing end of a sheet discharged by the first discharging device calculated from a distance between a discharging position of the first discharging device and the catching position and a discharging speed of the sheet discharged by the first discharging device, and the controller controls the swinging time period to a time period not more than the sliding time period.

Still more preferably, the controller comprises a determination device that determines at least one condition of the conveyed sheet, and, when the determination device determines that the conveyed sheet is thick paper, the controller carries out one of control to decrease the swinging time period and control to increase the sliding time period.

Also further preferably, the controller causes the second discharging device to return to the waiting position in timing in which a trailing end of a second sheet following a first sheet discharged by the second discharging device does not interfere with the second discharging device, based on a return time period over which the second discharging device is returned from the catching position to the waiting position and a moving time period over which the trailing end of the second sheet is moved to a predetermined location after the first sheet is discharged by the second discharging device.

More preferably, the sheet stacking apparatus comprises a detection device provided upstream of the first discharging device, for detecting the trailing end of the second sheet, and the controller causes the second discharging device to start returning to the waiting position when a bundle of sheets stacked on the first sheet stacking device is discharged in a bundle by the second discharging device or when the trailing end of the second sheet is detected by the detection device.

To attain the above object, a second aspect of the present invention, there is provided a sheet stacking apparatus comprising a sheet stacking device that stacks sheets, a discharging device that discharges a sheet conveyed from an upstream side thereof toward the sheet stacking device, a catching device that is swingable to selectively assume a catching state in which a sheet discharged to the sheet stacking device is caught by the catching device, and a non-catching state in which a sheet discharged to the sheet stacking device is not caught by the catching device, and a controller that controls the catching device to assume the non-catching state when the discharging device starts discharging a sheet, and switch to the catching state before a trailing end of the sheet discharged by the discharging device passes the catching device to prevent the sheet from jumping over the sheet stacking device.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail with reference to the accompanying drawings showing a preferred embodiment thereof.

Figure 1:
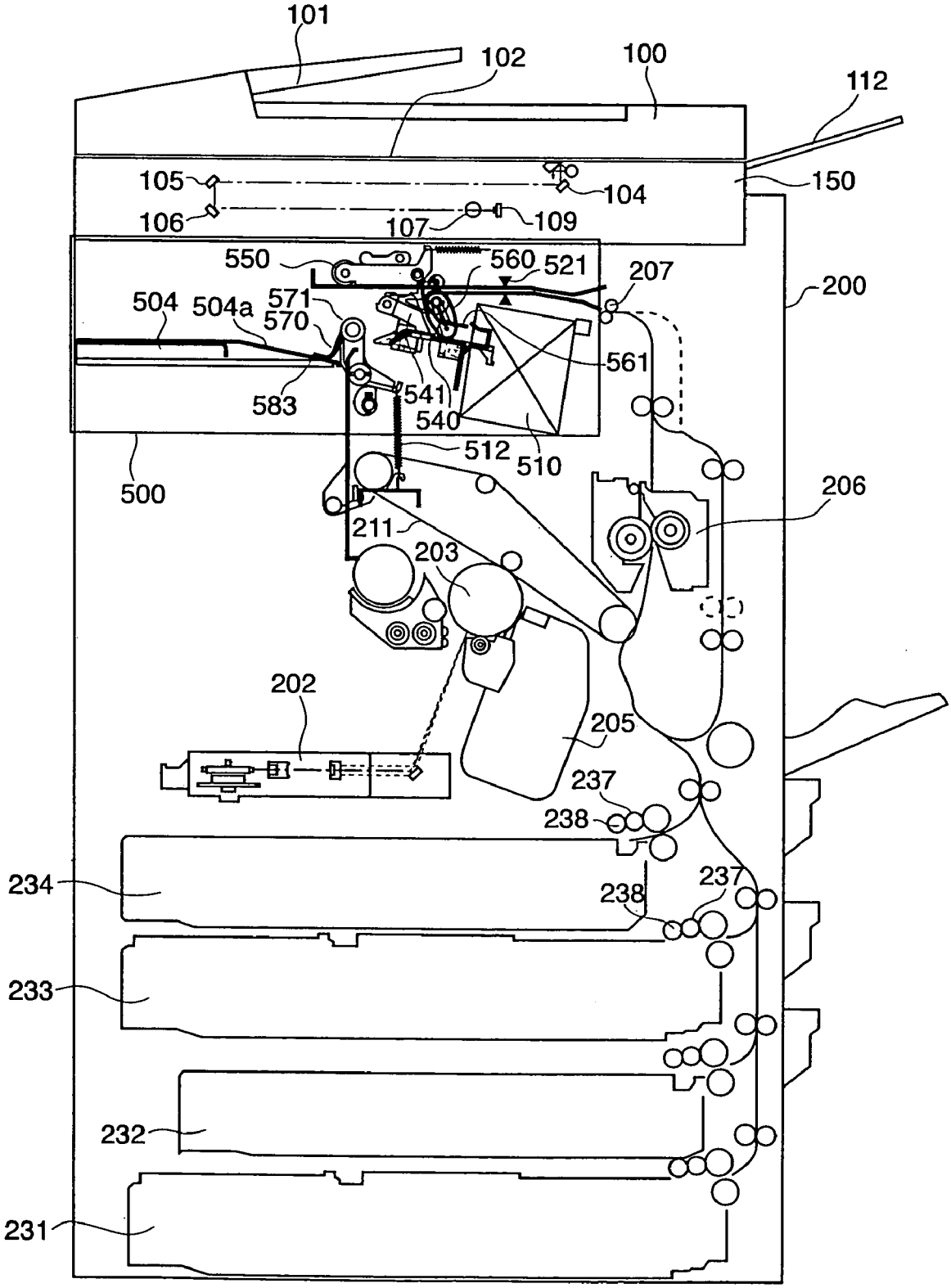
FIG. 1 is a sectional view showing the construction of an image forming apparatus provided with a sheet stacking apparatus according to an embodiment of the present invention.

FIG. 1 is a sectional view showing the construction of an image forming apparatus provided with a sheet stacking apparatus according to an embodiment of the present invention. In the present embodiment, a sheet processing apparatus is provided in the image forming apparatus. In FIG. 1, reference numeral 200 denotes an image forming apparatus main body. An original reader 150 is provided on an upper side of the image forming apparatus main body 200, and an automatic original reader 100 is mounted on top of the original reader 150. Further, the sheet processing apparatus 500 as the sheet stacking apparatus according to the present embodiment, which is stored in a housing of the image forming apparatus, is provided in an upper part of the image forming apparatus main body 200 and below the original reader 150.

The automatic original reader 100 separates originals, which are set on an original tray 101 with upper surfaces thereof facing upward, from the top, feeds the originals one by one in sequence from the top page to the left as viewed in FIG. 1, conveys each original onto a platen glass 102 via a curved path, not shown, and reads and discharges each original onto a discharged sheet tray 112.

Light from a lamp of a scanner unit 104 is irradiated upon the original placed on the platen glass 102, and light reflected from the original is led to an image sensor 109 via optical elements such as mirrors 105 and 106 and a lens 107, so that the original is read. Image data of the original read by the image sensor 109 is subjected to image processing, and then transmitted to an exposure controller 202. The exposure controller 202 emits laser light based on the image data.

The laser light is reflected by a rotating polygon mirror, and is reflected again by a reflex mirror and irradiated upon a photosensitive drum 203 with the surface thereof uniformly electrified. The irradiation of the laser light forms an electrostatic latent image on the photosensitive drum 203. The electrostatic latent image on the photosensitive drum 203 is developed by a developing device 205, and then transferred as a toner image on a sheet S such as thick paper and an OHP sheet.

Sheets S are selectively let out from a sheet cassette 231, 233, or 234 by a pick-up roller 238, and separated sheet by sheet by a separating section 237 and then fed. The sheet S is corrected for skew by a pair of pre-resist rollers, and led to a transfer position in synchronism with rotation of the photosensitive drum 203. This causes the toner image formed on the photosensitive drum 203 to be transferred onto the sheet S via a transfer belt 211.

The sheet S is then led to a pair of fixing rollers 206, and is heated and pressurized by the fixing rollers 206, so that the transferred toner image is fixed on the sheet S. A fixing upper separation claw and a fixing lower separation claw are disposed in abutment on the respective fixing rollers 206 to separate the sheet S from the fixing rollers 206. The separated sheet S is conveyed by a pair of main body side discharging rollers 207 to the sheet processing apparatus 500 provided in the housing of the image forming apparatus.

Figure 2:
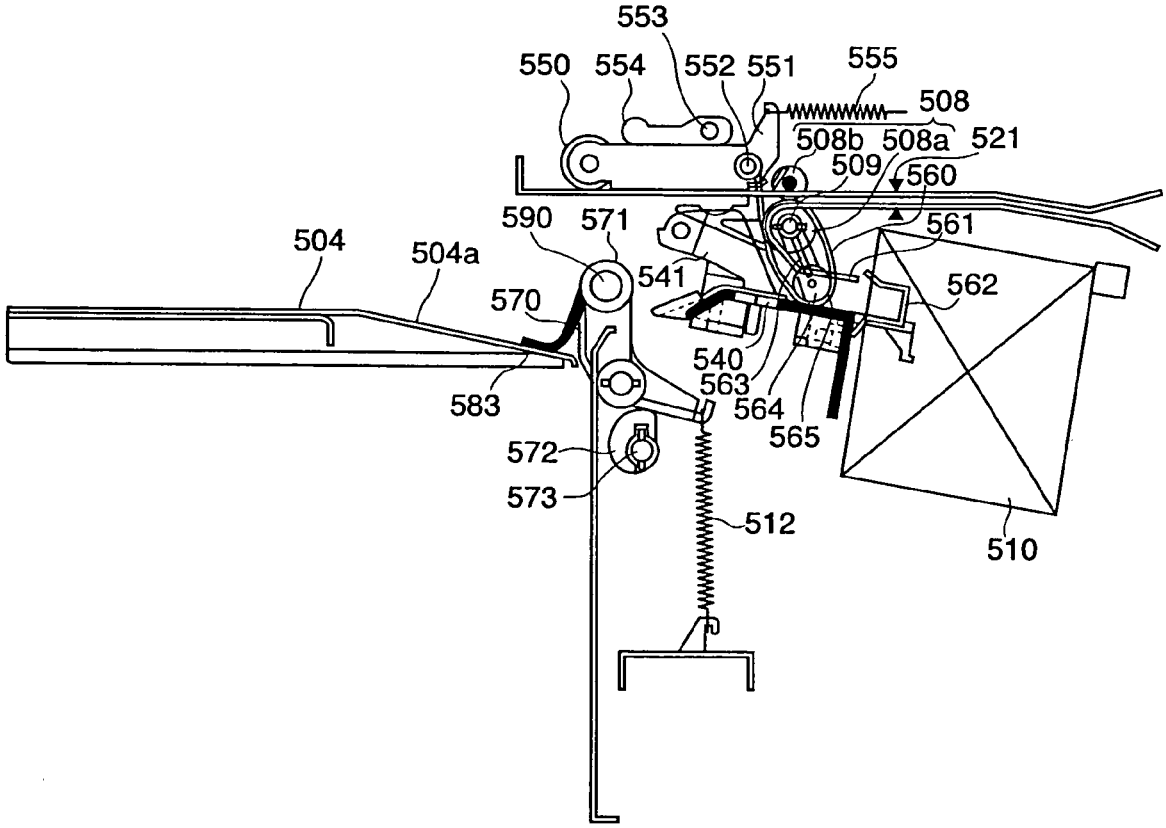
FIG. 2 is a front view showing the construction of a sheet processing apparatus appearing in FIG. 1.
Figure 3:
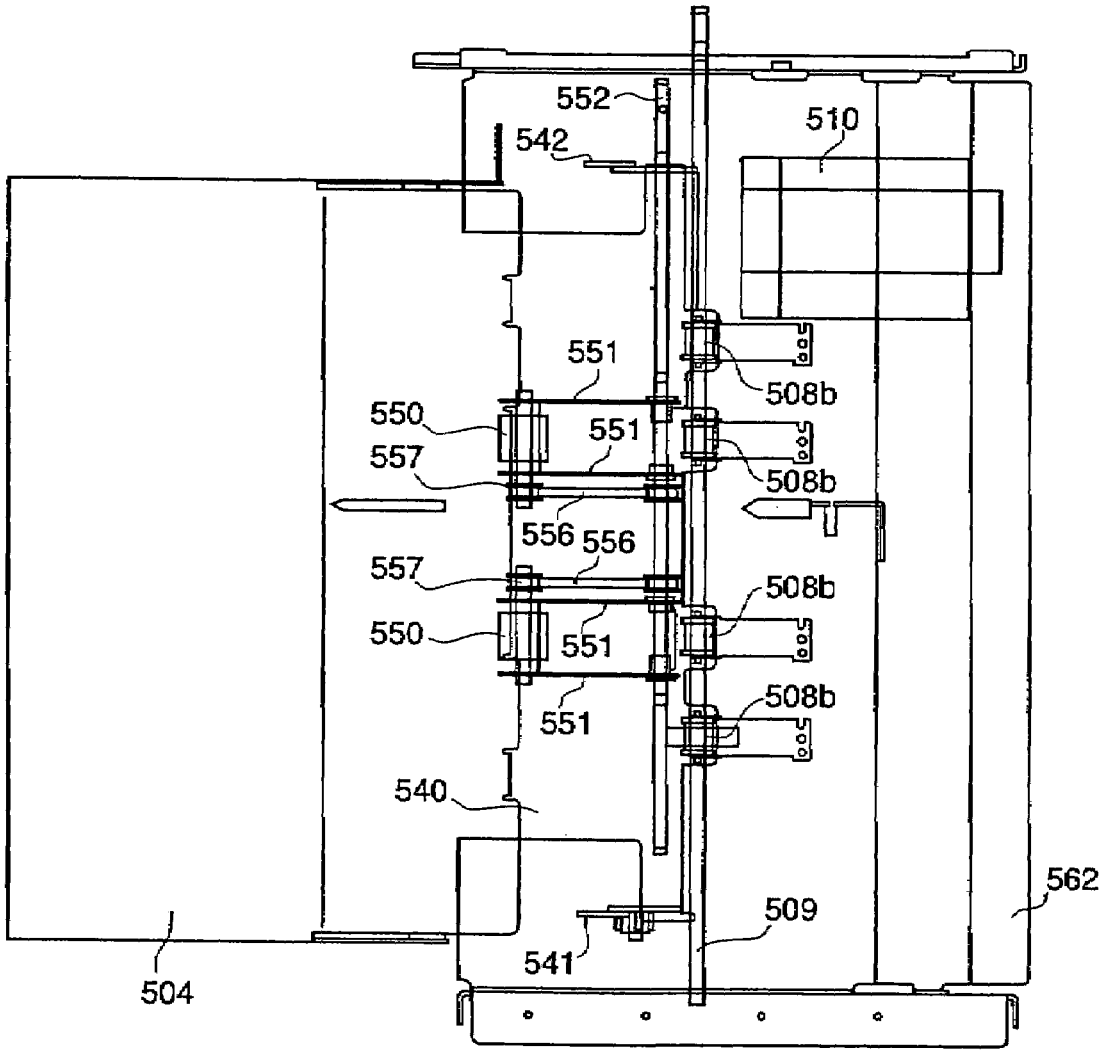
FIG. 3 is a plan view showing the construction of the sheet processing apparatus in FIG. 2.

FIG. 2 is a front view showing the construction of the sheet processing apparatus 500 provided in the image forming apparatus in FIG. 1. FIG. 3 is a plan view showing the construction of the sheet processing apparatus 500. The sheet processing apparatus 500 includes a processing tray 540 located at a relatively upstream location and on which sheets S with images formed thereon discharged from the image forming apparatus main body 200 are temporarily stacked, and a stack tray 504 which is located downstream of the processing tray 540 and disposed substantially horizontally and on which sheets S discharged from the processing tray 540 are stacked.

The sheet S discharged by the main body side discharging rollers 207 of the image forming apparatus main body 200 is discharged toward the stack tray 504 by a discharging section 508 on the sheet processing apparatus 500 side, which is comprised of a discharging roller 508*a* and a discharging roller 508*b* following the discharging roller 508*a*. On this occasion, in timing in which the trailing end of the sheet S passes the discharging section 508, the trailing end of the sheet S is dropped onto the processing tray 540 by a swinging roller 550, into a state sandwiched between the swinging roller 550 and a following roller 571. The operation of the swinging roller 550 will be described later in further detail.

The sheets S thus discharged onto the processing tray 540 in the sheet processing device 500 are subjected to post processing such as stapling and aligning on the processing tray 540, and then stacked on the stack tray 504. Examples of post processing modes executed on the processing tray 540 are a sort mode in which sheets S are sorted into a plurality of groups, and a stapling mode in which a plurality of sheets are stapled by a stapler unit 510. The post processing mode is selected and set by an operator via an operating section 380 (refer to FIG. 25) before a post processing job is started. In the stapling mode, it is possible to designate one-point stapling, two-point stapling, stapling position, or the like. The stapler unit 510 moves to a stapling position according to settings as to sheet size, stapling position, and so forth.

Figure 4A:
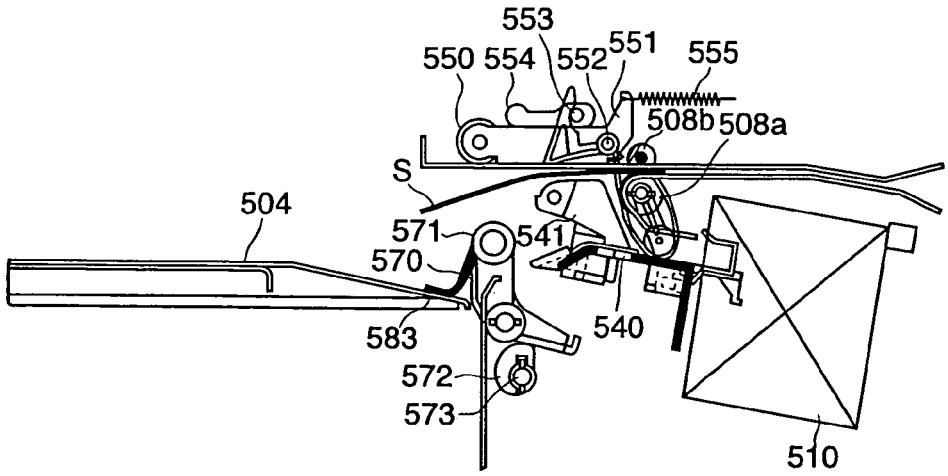
FIGS. 4A to 4C are views useful in explaining the operation of a swinging roller in the sheet processing apparatus.
Figure 4B:
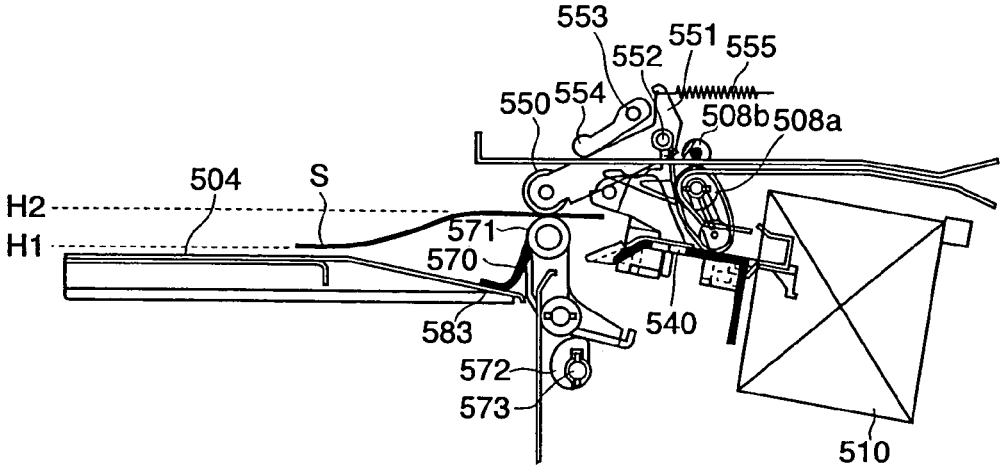
Figure 4C:
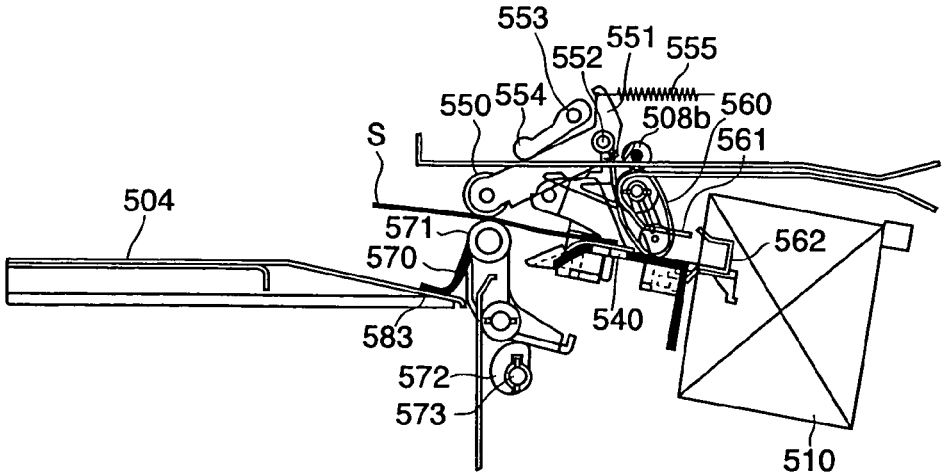

FIGS. 4A to 4C are views useful in explaining the operation of the swinging roller 550 of the sheet processing apparatus 500. The swinging roller 550 is attached to a free end of a swinging arm 551 which is capable of vertically swinging about a swinging roller shaft 552. Power is transmitted from a swinging arm driving motor 643 (refer to FIG. 26) to a swinging arm shaft 553 which pivotably supports a swinging cam 554. In response to rotation of the swinging arm driving motor 643, the swinging arm 551 vertically swings about the swinging roller shaft 552 in unison with the swinging cam 554. Further, a swinging arm tension spring 555 for assisting in upward swinging of the swinging arm 551 is attached to the swinging arm 551.

The swinging roller 550 is connected to the swinging roller driving motor 643 (refer to FIG. 26) via a swinging roller driving belt 556 (refer to FIG. 3), a swinging roller following pulley 557, and the swinging roller shaft 552. When the swinging roller driving motor 642 is rotated in response to a driving signal transmitted from a CPU 611, described later with reference to FIG. 26, via a roller driving motor driver 622, torque of the swinging roller driving motor 642 is transmitted to the swinging roller 550, so that the swinging roller 550 is rotated.

As shown in FIG. 4A, the home position of the swigging roller 550 is set at an upper location so as not to abut on the sheet S discharged onto the processing tray 540 by the discharging section 508. When the sheet S is discharged from the discharging section 508, and the arm 551 rotates counterclockwise about the swinging roller shaft 552 in response to driving energy from the swinging arm driving motor 643, the swinging roller 550 moves down to press the trailing end of the discharged sheet S and drops it toward the processing tray 540, whereby the sheet S is sandwiched between the swinging roller 550 and the following roller 571, as shown in FIG. 4B. On this occasion, as shown in FIG. 4B, a vertical position H1 at which the leading end of the sheet S having passed the discharging section 508 contacts the stacking surface of the stack tray 504 is lower than the highest vertical position H2 of the following roller 571 (that is, the highest portion of a stacking surface formed by the processing tray 540 and the following roller 571 (see FIG. 5A)). This is because the stack tray 504, which is disposed below the original reader 150 and at an upper location inside the image forming apparatus main body 200, is disposed more horizontally than the conventional stack tray so as to secure a sufficient stacking capacity of the stack tray 504. With this construction, however, if the sheet S is not sandwiched between the swinging roller 550 and the following roller 571 in predetermined timing, the sheet S having passed the discharging section 508 spontaneously drops onto the stack tray 504 instead of dropping onto the stacking surface formed by the processing tray 540 and the following roller 571. To eliminate this inconvenience, control is provided to lower the swinging roller 550 in predetermined timing, as described later.

The swinging roller 550, when lowered, forms a nip with the following roller 571, and rotates counterclockwise in response to driving energy from the swinging roller driving motor 642, so that as shown in FIG. 4C, the sheet S is pulled along a lower guide 561 in a direction opposite to the direction in which the sheet S has been conveyed until the trailing end of the sheet S dropped onto the processing tray 540 abuts on a return belt 560. Thereafter, the swinging roller 550 moves up to the home position shown in FIG. 4A, and prepares for discharge of the next sheet S. The sheet discharging operation carried out by the swinging arm 551 and the discharging roller 508*a* will be described in detail later.

Figure 5A:
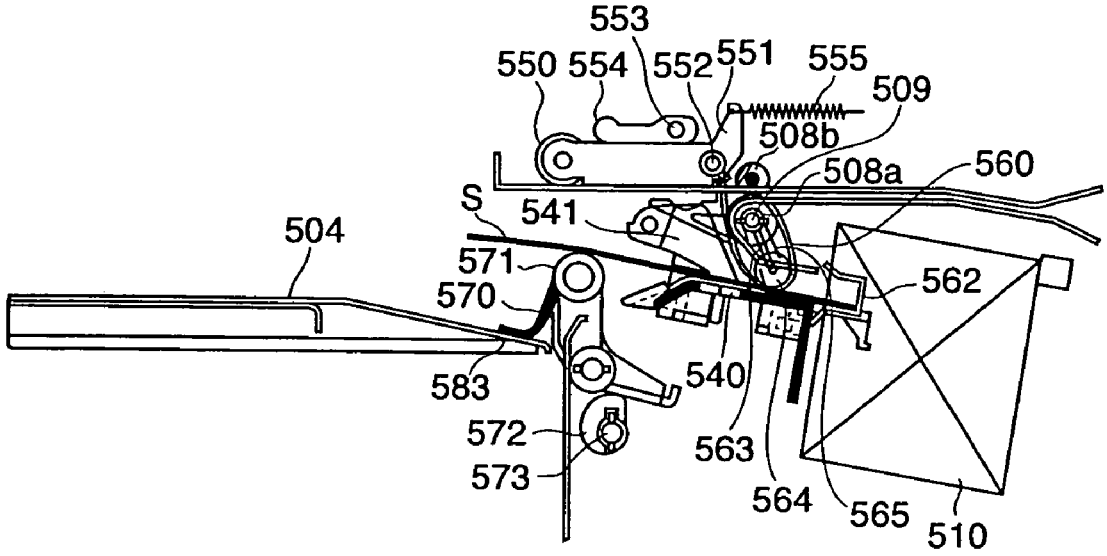
FIGS. 5A and 5B are views useful in explaining the operation of a return belt in the sheet processing apparatus.
Figure 5B:
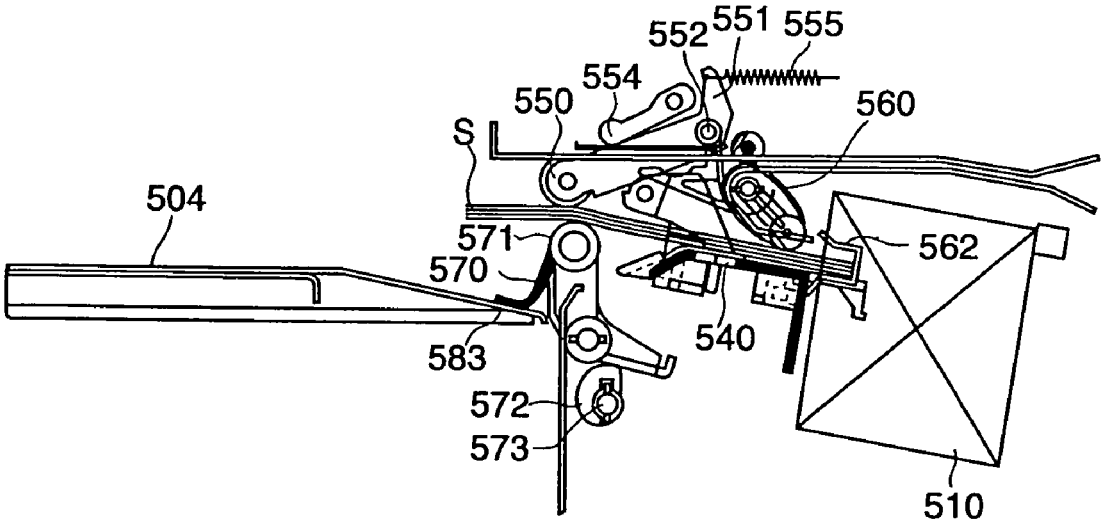

FIGS. 5A and 5B are views useful in explaining the operation of the return belt 560 in the sheet processing apparatus 500. The return belt 560 is supported by a discharging roller shaft 509, and is comprised of the discharging roller 508 pivotably supported by the discharging roller shaft 509, a return belt pulley 564 supported by a housing 563, and a belt member 565 wound around the discharging roller 508*a* and the return belt pulley 563 (refer to FIG. 2). The return belt 560 is at least one sheet feeding rotary member, and is normally disposed at such a location as to come into contact with the sheet S on the processing tray 540 so as to urge the sheet S against a sheet trailing stopper 562.

As shown in FIG. 5A, when the discharging roller shaft 509 rotates counterclockwise, the belt member 565 conveys the sheet S in a direction toward the sheet trailing stopper 562. Further, as shown in FIG. 5B, the return belt 560 swings in such a manner as to go away from the sheets S stacked on the processing tray 540 with an increase in the thickness of the sheet stack.

The sheets S thus pressed counterclockwise by the swinging roller 550 and the return belt 560 are received by the sheet trailing end stopper 562 located at an end of the processing tray 540, and aligned sheet by sheet in the sheet conveying direction.

A front aligning plate 541 and a rear aligning plate 542 (refer to FIG. 3), which are moveable in parallel with the discharging roller shaft 509 are provided on the sheet processing tray 540. The front aligning plate and the rear aligning plate 542 are driven by a front aligning motor 646 (refer FIG. 26) and a rear aligning plate 647 (refer FIG. 26), respectively.

While the sheet processing apparatus 500 is not in operation, the front aligning plate 541 and the rear aligning plate 542 are waiting at respective positions which are detected by a front alighting home position sensor 530 (refer to FIG. 26) and a rear aligning home position sensor 531 (refer to FIG. 26), respectively. These positions are called "aligning home positions (reference positions)", and are set at positions such that the sheet S being conveyed does not come into contact with the front aligning plate 541 and the rear aligning plate 542.

The front aligning plate 541 and the rear aligning plate 542 move to respective waiting positions suitable for the size of the sheets S before the sheets S are conveyed from the image forming apparatus. After the sheets S are aligned in the sheet conveying direction as above, the front aligning plate 541 and the rear aligning plate 542 are moved to respective sheet aligning positions in the post-processing mode set before the start of a job, so that the sheets S are aligned in the direction of the width thereof, i.e. in a direction perpendicular to the sheet conveying direction.

For example, in the case where the sheets S of the Nth copy are aligned in the direction of the width thereof in the sort mode, the front aligning plate 541 is caused to wait at the reference position, and the rear aligning plate 542 is moved from the waiting position to the sheet aligning position, so that the sheets S are aligned at edges thereof at an inner side with respect to the sheet surface of FIGS. 5A and 5B. Then, as described later, the aligned sheets S are discharged to the stack tray 540.

In the case where the sheets S of the N+1th copy are aligned, the rear aligning plate 542 is caused to wait at the reference position, and the front aligning plate 541 is moved from a waiting position to an aligning position, so that the sheets S are aligned at edges thereof at an outer side with respect to the sheet surface of FIGS. 5A and 5B thereof. Then, the aligned sheets S are discharged to the stack tray 540 as above. As a result, the sheets S can be stacked on the stack tray 540 while they are sorted each time a bundle of sheets S is discharged. It should be noted that the sheets S may be aligned at middle positions thereof, and in this case, both the front aligning plate 541 and the rear aligning plate 542 are moved from respective waiting positions to aligning positions suitable for the middle positions.

Also, when the stapling mode is selected, the sheets S are aligned in the direction of the width thereof at a position suitable for a set stapling position, and then they are stapled. On this occasion, the stapler unit 510 is driven by a staple clinch motor 648 (refer to FIG. 26) to staple the sheets S. The stapler unit 510 is driven by a staple slide motor 649 (refer to FIG. 26) to freely move in a direction vertical to the sheet surface of FIGS. 5A and 5B (i.e. in a direction vertical to the sheet conveying direction). Upon the start of a job, the stapler unit 510 moves to an actual stapling position which has been determined in dependence on a stapling position and a sheet size designated before the start of the job. Then, the stapler unit 510 staples a bundle of the sheets S aligned in the direction of the width thereof as above.

Figure 6A:
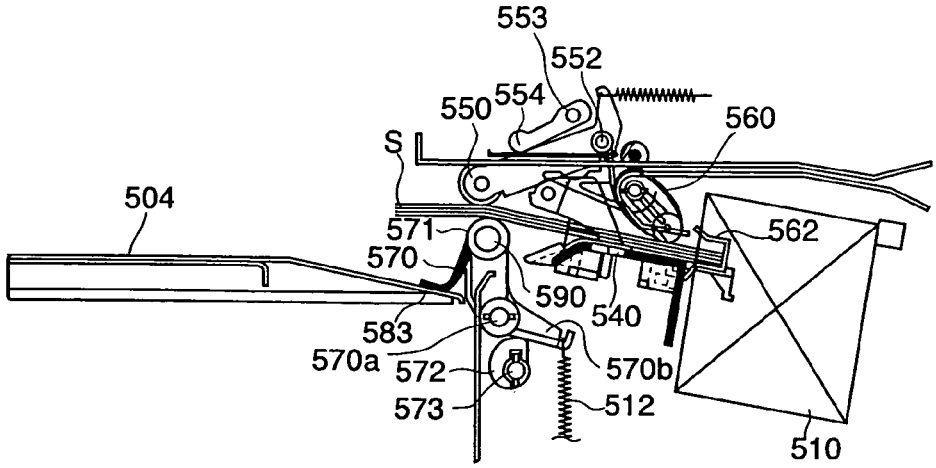
FIGS. 6A to 6C are views useful in explaining a bundle discharging operation carried out by the swinging roller.
Figure 6B:
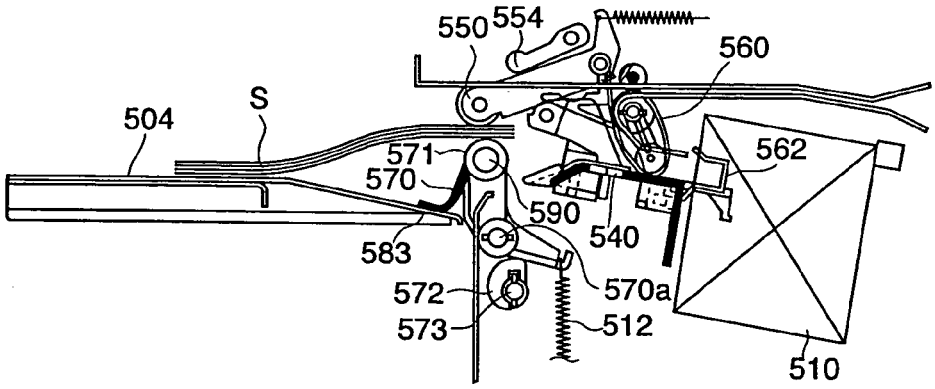
Figure 6C:
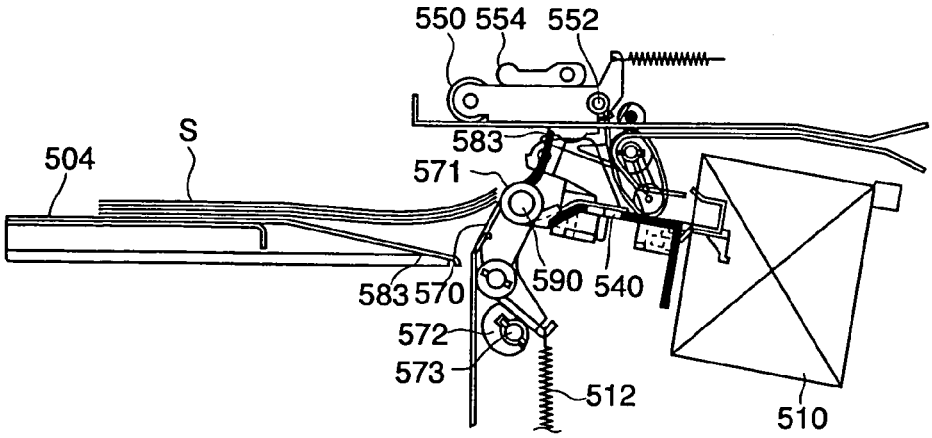

FIGS. 6A to 6C are views showing how a bundle of sheets S is discharged by the swinging roller 550. After a bundle of sheets S is aligned in the sheet conveying direction and in the direction of the width thereof, and stapled as above, the swinging roller 550 is driven by the swinging arm driving motor 643 to move down about the swinging roller shaft 552 until it abuts on the bundle of sheets S as shown in FIG. 6A. Then, the swinging roller 550 forms a nip with the following roller 571, and rotates clockwise to convey the bundle of sheets S until the trailing end of the bundle of the sheets S reaches a position in the vicinity of an upper end of a trailing end aligning wall member 570 (refer to FIG. 6B), and then stops the bundle of sheets S.

Then, the swinging roller 550 comes apart from the bundle of sheets S and returns to its home position (refer to FIG. 6C). At the same time, a cam 572 located below the trailing end aligning wall 570 rotates about a cam swinging rotary shaft 573, the trailing end aligning wall 570 swings about a swinging shaft 570*a* in a direction away from the bundle of sheets S. The operations of the trailing end aligning wall member 570 and the cam 572 will be described later.

Figure 7A:
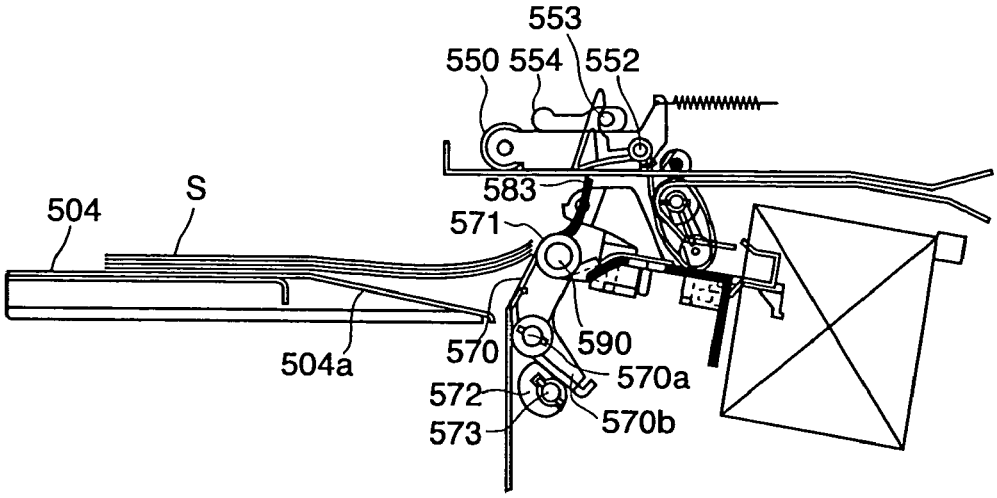
FIGS. 7A to 7C are views useful in explaining an operation of discharging a bundle of sheets on a processing tray of the sheet processing apparatus onto a stack tray, and aligning/stacking the bundle of sheets on the stack tray.
Figure 7B:
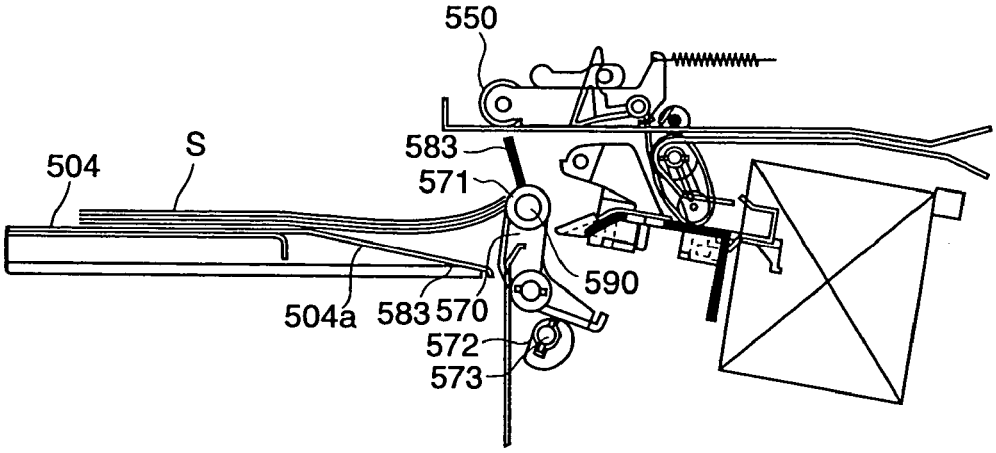
Figure 7C:
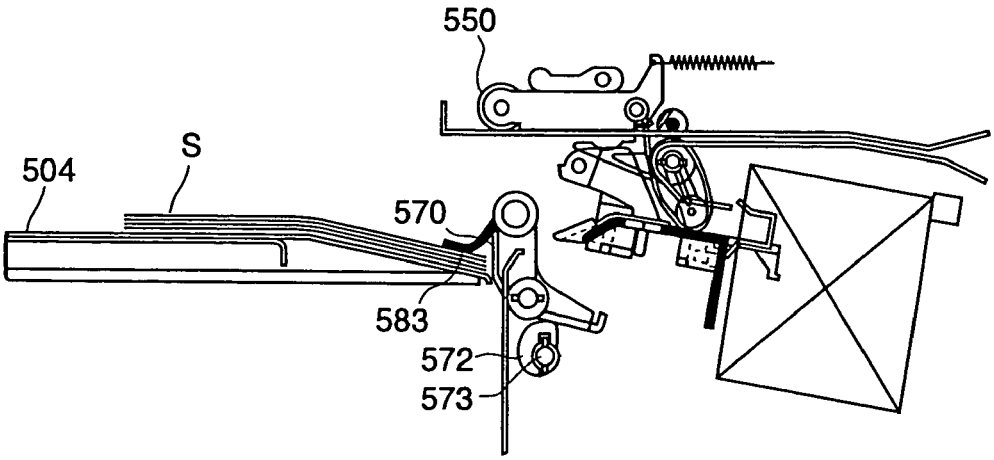

FIGS. 7A to 7C are views showing how a bundle of sheets S on the sheet processing tray 540 of the sheet processing apparatus 500 is discharged onto the stack tray 504, and aligned and stacked on the stack tray 540. The rear end aligning wall member 570 can swing about the swinging rotary shaft 570*a*, and has one end 570*b* thereof urged by a spring 512. The one end 570*b* is in abutment on the cam 572 that is rotatable about the cam swinging rotary shaft 573; when the cam 572 lying at its home position (refer to FIG. 6A) rotates, the rear end aligning wall member 570 swings in a direction opposite to the direction in which the bundle of sheets S is conveyed.

The trailing end of the discharged bundle of sheets S comes into abutment on the upper end of the trailing end aligning wall member 570 (refer to FIG. 6B), the trailing end aligning wall member 570 is moved back upstream in the sheet conveying direction, so that the trailing end of the bundle of sheets S comes into abutment on an inclined surface of the trailing end aligning wall member 570 (refer to FIGS. 6C and 7A).

When the moved-back trailing end aligning wall member 570 returns to its home position (refer to FIG. 6A) while swinging about the swinging rotary shaft 570*a*, the trailing end aligning wall member 570 urgingly moves the trailing end of the bundle of sheets S in a horizontal direction while aligning the bundle of sheets S at the rear edge thereof, so that the bundle of sheets S is stacked on the stack tray 504 (refer to FIGS. 7B and 7C).

The bundle of sheets S stacked on the stack tray 504 is pulled back toward the trailing end aligning wall member 570 and pressed at the top thereof by a sheet returning member 583. The sheet returning member 583 is a puddle-like member freely rotatable about a puddle rotary shaft 590 provided on the rear end aligning wall member 570. The sheet returning member (puddle) 583 makes one rotation counterclockwise each time a bundle of sheets S is discharged onto the stack tray 504 by the swinging roller 550, and pulls back the discharged bundle of sheets S toward the trailing end aligning wall member 570 to press the trailing end of the bundle of sheets S.

Here, the sheet returning member 583 is kept in a state shown in FIGS. 6A and 6B to press the bundle of sheets S except when it carries out the sheet bundle pulling-back operation. The position of the sheet returning member 583 is detected by a puddle home position sensor, not shown. The stack tray 504 is configured to be moved up and down by a driving mechanism, not shown, so as to keep the height of stacked bundle of sheets S constant.

It should be noted that although in the present embodiment, the stack tray 504 has its sheet stacking surface lying on a substantially horizontal plane, the sheet stacking surface may be inclined. Even if the sheet stacking surface of the stack tray 504 is inclined, the trailing end aligning wall member 570 is capable of operating effectively. Further, if the sheet stacking surface of the stack tray 540 is inclined downward toward the trailing end aligning wall member 570 (in the present embodiment, the angle of inclination is set to 18°), the interference of the trailing end of a bundle of sheets S stacked on the stack tray 540 with the following bundle of sheets S discharged from the processing tray 540 can be easily avoided, and the sheet processing apparatus can be reduced in size.

Figure 8:
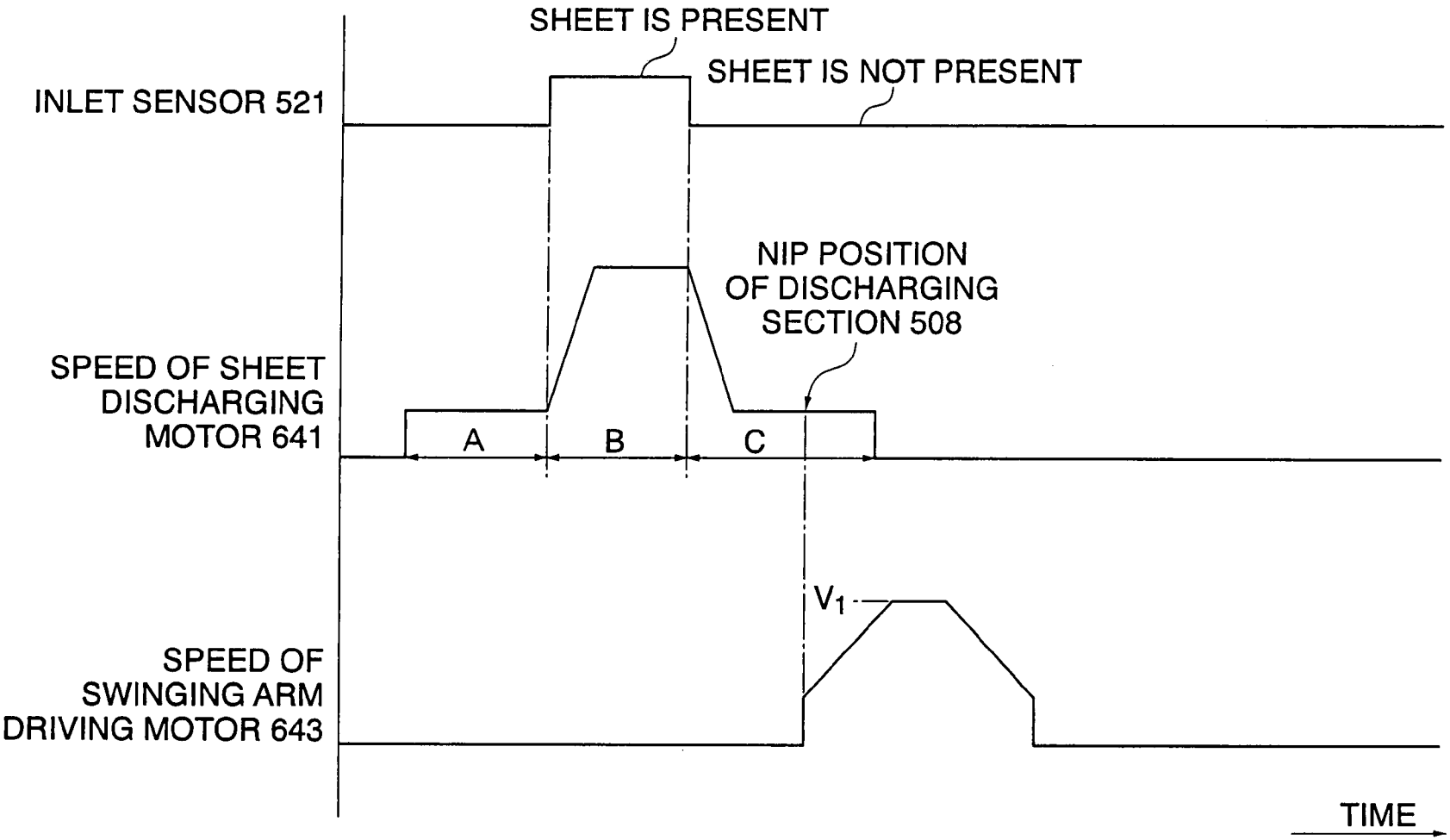
FIG. 8 is a timing chart showing changes with time in a signal indicative of presence of a sheet output from an inlet sensor, a voltage signal converted from the rotational speed of a sheet discharging motor, and a voltage signal converted from the rotational speed of a swinging arm driving motor.

Here, the operations of the swinging arm 551 and the discharging roller 508*a* will be described in detail. FIG. 8 is a timing chart showing changes with time in a signal indicative of presence of a sheet output from an inlet sensor 521, a voltage signal converted from the rotational speed of a sheet discharging motor 641 (refer to FIG. 26), and a voltage signal converted from the rotational speed of the swinging arm driving motor 643. The inlet sensor 521 is disposed at a location shown in FIGS. 1 and 2, and the sheet discharging motor 641 is implemented by a pulse motor and drives a pair of inlet conveying rollers (the discharging section 508) and the discharging roller 508*a* forming the return belt 560. The swinging arm driving motor 643 vertically drives the swinging arm 551.

When a sheet S, on which an image has been formed at the image forming apparatus main body 200 is handed over to the sheet processing apparatus 500, the discharging roller

508*a* in the sheet processing apparatus 500 is driven at a speed equal to the sheet conveyance speed of the image forming apparatus main body 200 by the sheet discharging motor 641 (a region A in FIG. 8). When the leading end of the sheet S has reached the inlet sensor 521, the sheet discharging motor 641 is accelerated so that the interval between the sheet S and a succeeding sheet increases (a region B in FIG. 8). When the trailing end of the sheet S has passed the inlet sensor 521, the sheet discharging motor 641 is decelerated to the original sheet conveyance speed until the trailing end of the sheet S leaves a nip formed by the discharging roller 508*a* and the discharging roller 508*b* (a region C in FIG. 8).

Next, to prevent the sheet S discharged from the discharging roller 508*a* from slipping off the processing tray 540 onto the stack tray 504, the swinging arm driving motor 643 is controlled such that a lowering movement of the swinging arm 551 is started in timing when the trailing end of the sheet S reaches the nip formed by the discharging roller 508*a* and the discharging roller 508*b* (the nip position of the discharging section 508 in FIG. 8). By this control, before the trailing end of the sheet S drops onto the stack tray 504 through the following roller 571, the swinging roller 550 provided on the swinging arm 551 lowers into contact with the following roller 571. Namely, before the trailing end of the sheet S drops onto the stack tray 504 through the following roller 571, the sheet S can be caught by the swinging roller 550 and the following roller 571. The swinging arm driving motor 643 is started at a time point when the sheet discharging motor 641 has been supplied with a predetermined number of pulses corresponding to the distance between the inlet sensor 521 and the nip formed by the discharging rollers 508*a*, 508*b* after the output signal from the inlet sensor 521 falls, or at a time point when a predetermined travel amount corresponding to the distance between the inlet sensor 521 and the nip formed by the discharging rollers 508*a*, 508*b* has been measured by an encoder, not shown, journalled on the sheet discharging motor 641 after the output signal from the inlet sensor 521 falls. Alternatively, the swinging arm driving motor 643 may be started at a time point when a predetermined time period corresponding to the distance between the inlet sensor 521 and the nip formed by the discharging rollers 508*a*, 508*b* has been measured by a timer, not shown, after the output signal from the inlet sensor 521 falls.

Figure 9:
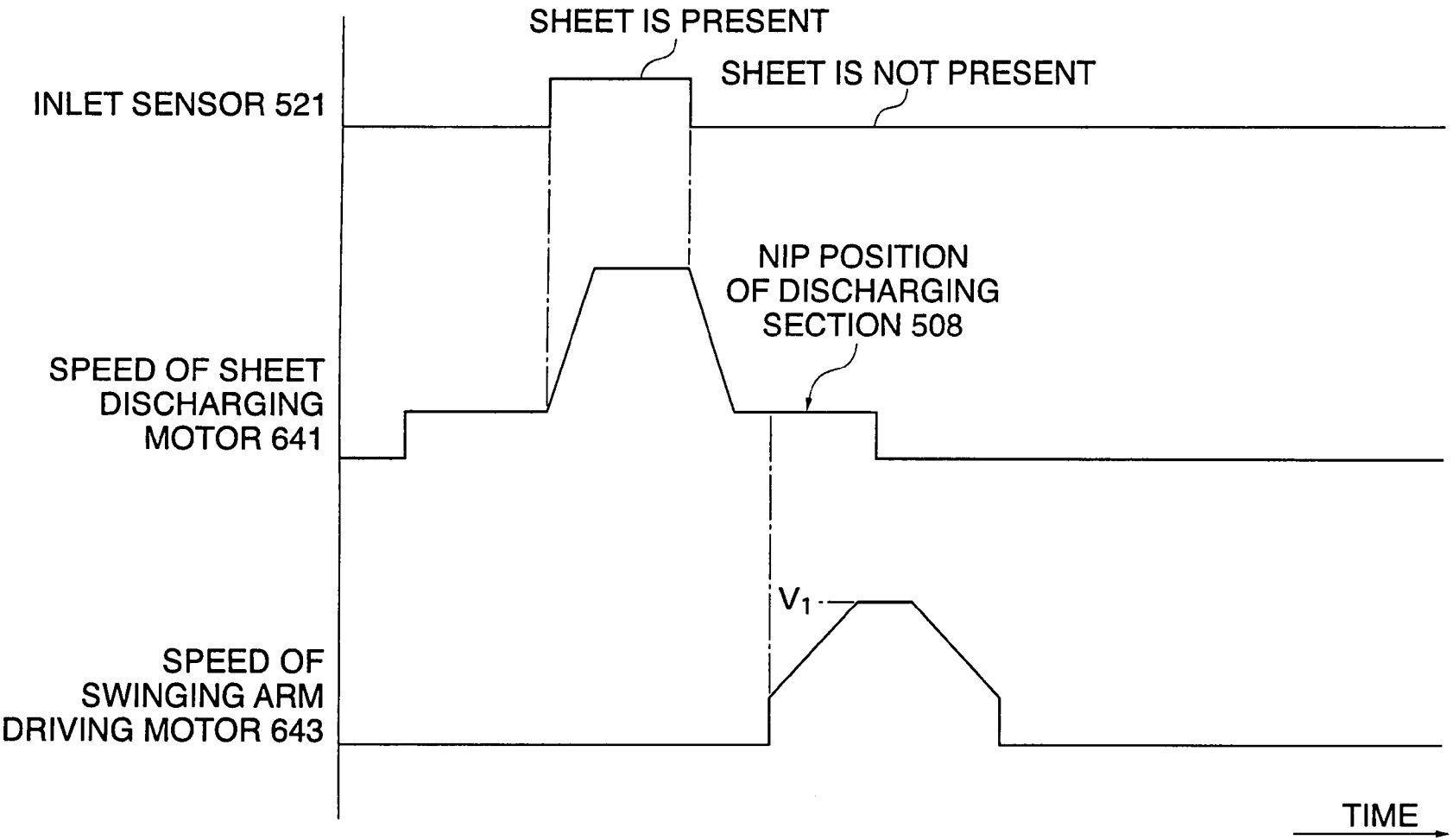
FIG. 9 is a timing chart similar to FIG. 8 when the timing in which the swinging arm driving motor is activated has been changed.

FIG. 9 is a timing chart similar to FIG. 8 when the timing in which the swinging arm driving motor 643 is activated has been changed. In FIG. 9, compared with FIG. 8, the timing in which the sheet discharging motor 643 is started is set earlier than the case of FIG. 8. The timing for starting the singing arm driving motor 643 is set to such appropriate timing that the swinging roller 550 attached to the end of the swinging arm 551 can surely catch the discharged sheet and at the same time the swinging arm 551 does not hinder the succeeding sheet from being discharged.

Figure 10:
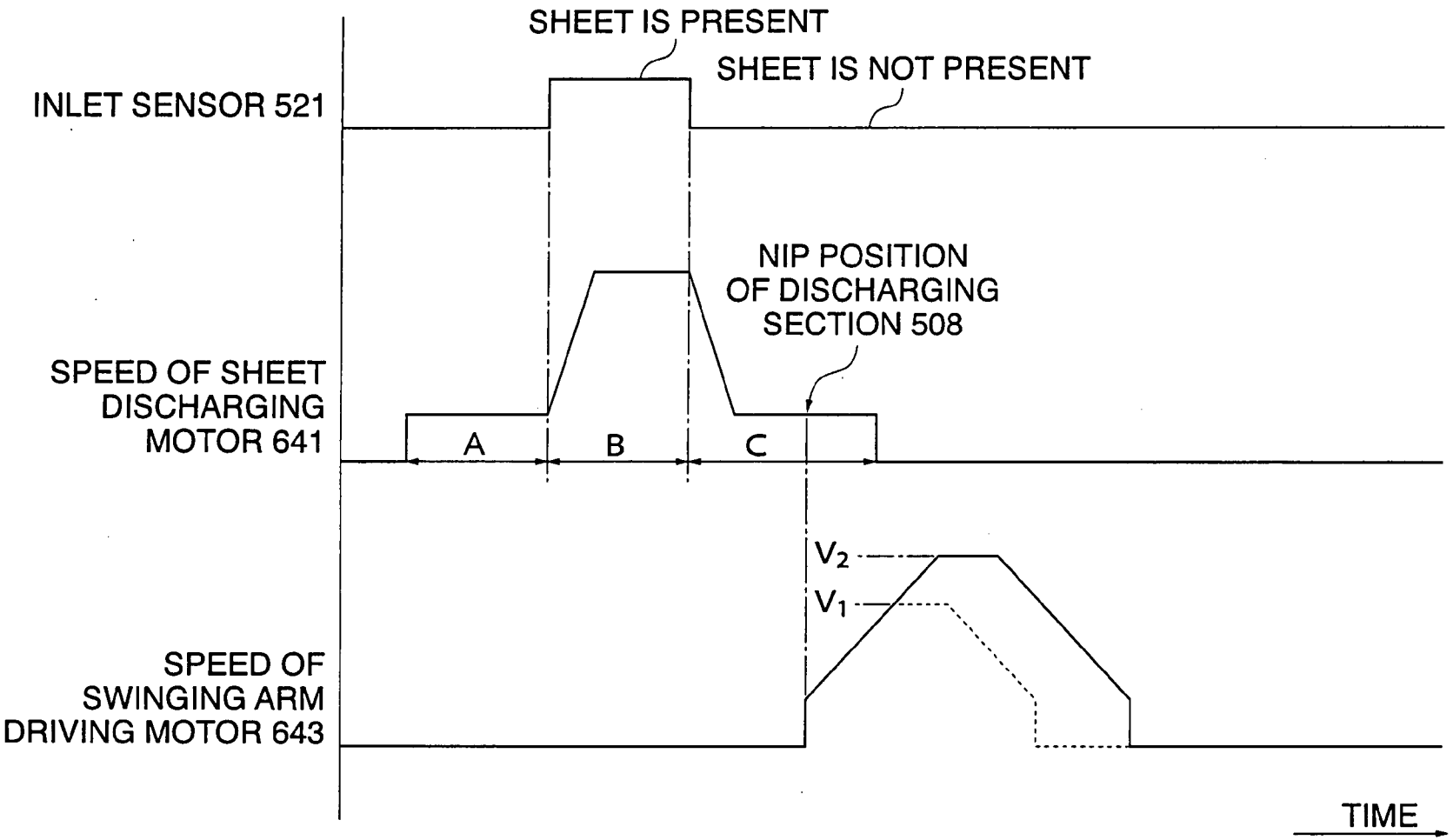
FIG. 10 is a timing chart similar to FIG. 8 when the operating voltage of the swinging arm driving motor has been changed.

Further, it is possible to optimize the motion of the swinging arm 551 by changing the operating voltage of the swinging arm driving motor 643 from a voltage V1 to a voltage V2 (V1<V2) to thereby change the operating speed of the same. FIG. 10 is a timing chart similar to FIG. 8 when the operating voltage of the swinging arm driving motor 643 has been changed.

Figure 11:
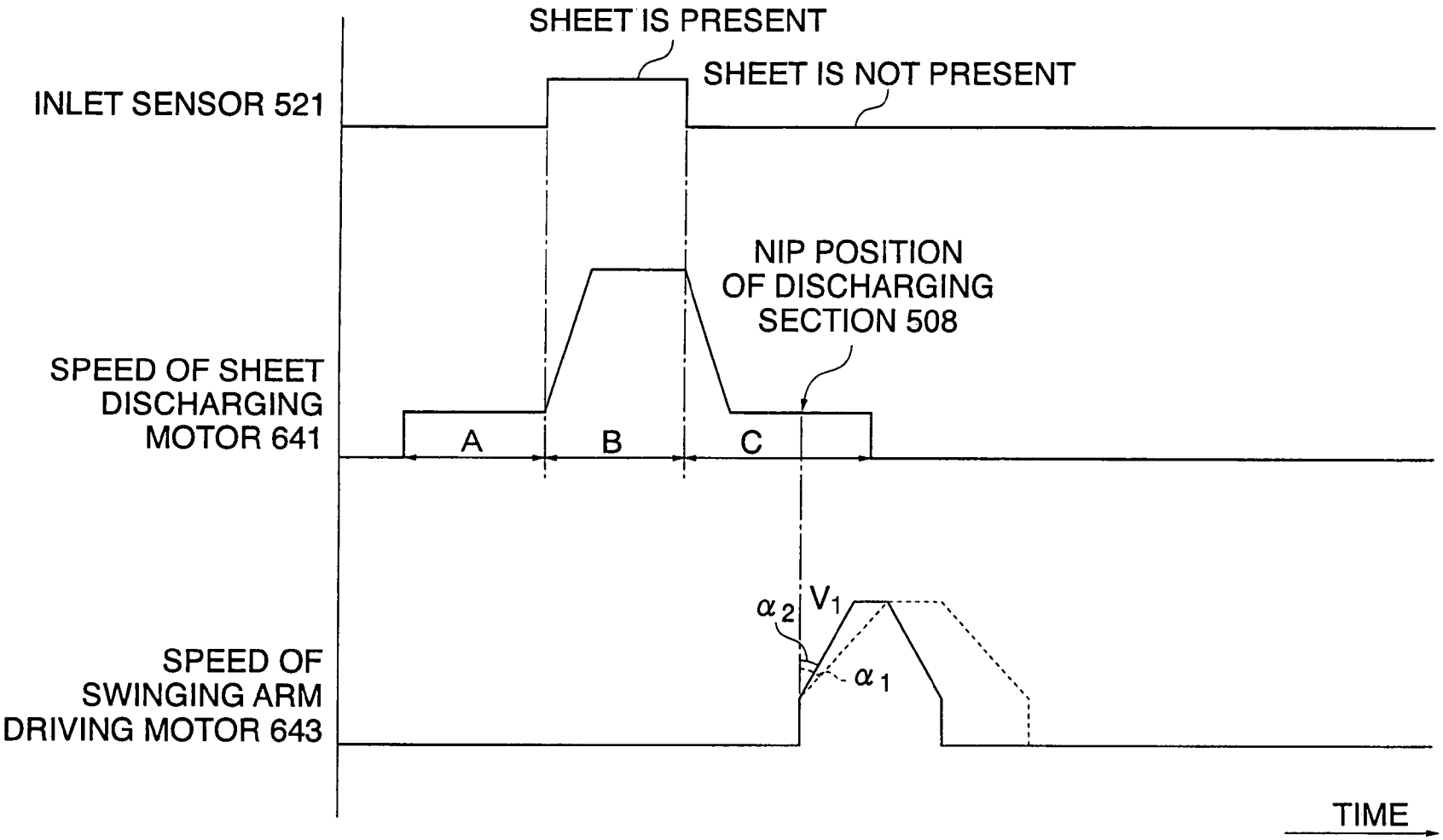
FIG. 11 is a timing chart similar to FIG. 8 when the operating acceleration of the swinging arm driving motor has been changed.

Furthermore, it is possible to optimize the motion of the swinging arm 551 by changing the operating acceleration of the swinging arm driving motor 643 from an acceleration $\alpha 1$ to an acceleration $\alpha 2$ ($\alpha 1<\alpha 2$) to thereby prevent the trailing end of the sheet S from slipping onto the stack tray 504 through the following roller 571. FIG. 11 is a timing chart similar to FIG. 8 when the operating acceleration of the swinging arm driving motor 643 has been changed.

At least one of the start timing of the swinging arm 551, the operating speed of the swinging arm driving motor 643, and the operating acceleration of the same may be changed according to the material, thickness, size, etc. of the sheet, to thereby enable the swinging arm 551 to reliably perform the sheet catching operation irrespective of the type of a sheet that is conveyed.

Figure 12A:
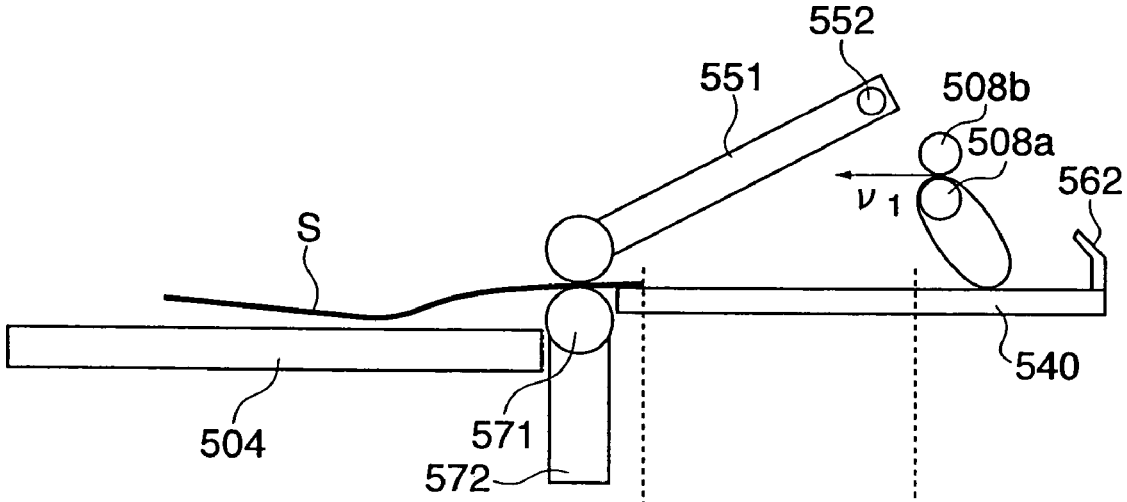
FIGS. 12A and 12B are views showing respective different landing states of a sheet depending upon the discharging speed of the sheet discharged from a discharging roller.
Figure 12B:
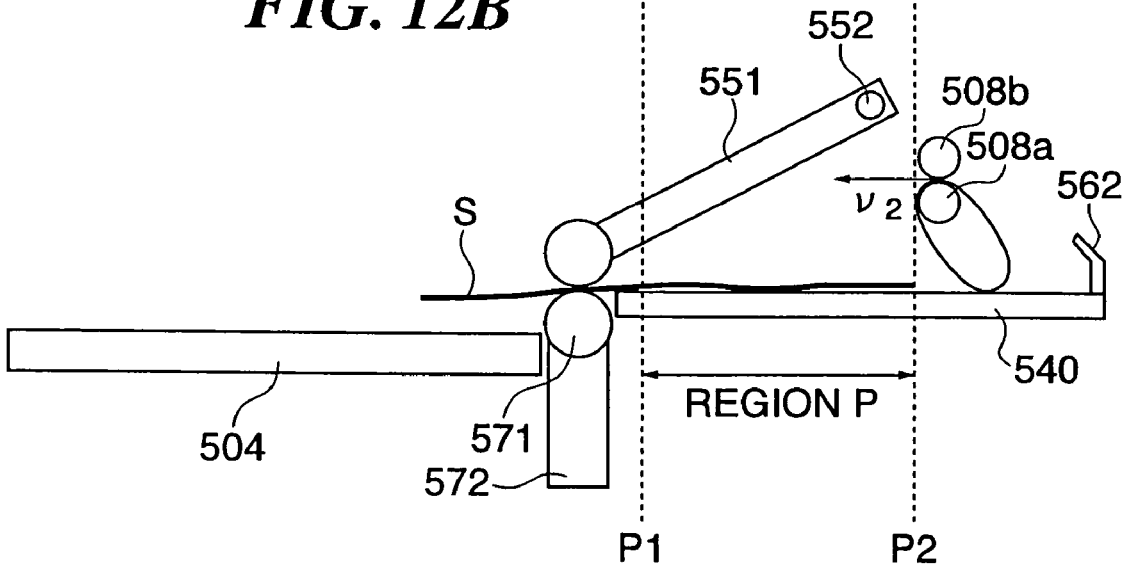

Next, a description will be given of a method of controlling the discharging speed of a sheet discharged by the discharging roller 508*a*. FIGS. 12A and 12B are views showing respective different landing states of a sheet depending upon the discharging speed of the sheet discharged from the discharging roller 508*a*. If the trailing end of the sheet S lies within a region P in FIGS. 12A and 12B when the swinging arm 551 is lowered, the swinging arm 551 can catch the sheet S.

Thus, provided that the discharging speed of a sheet discharged from the discharging section 508 is designated by $v$, the discharging speed $v$ must satisfy the relationship of $v \leqq v1$, where $v1$ represents the discharging speed of the discharged sheet S when the trailing end of the discharged sheet S lands at a position P1 (refer to FIG. 12A). If $v>v1$ holds, the sheet S cannot be caught by the swinging arm 551 and slips onto the stack tray 504.

On the other hand, to prevent that the trailing end of the sheet does not stay at the discharging section 508 when the swinging arm 551 is lowered, the discharging speed of the sheet discharged from the discharging section 508 must satisfy the relationship of $v \geqq v2$, where $v2$ represents the discharging speed of the discharged sheet S when the trailing end of the discharged sheet S lands at a position P2 (refer to FIG. 12B). If $v2 \leqq v \leqq v1$ holds, the trailing end of the discharged sheet S lies within the region P, and hence the sheet S can be reliably caught. Therefore, the discharging speed $v$ of the sheet S is controlled so as to satisfy the relationship of $v2 \leqq v \leqq v1$.

Figure 13:
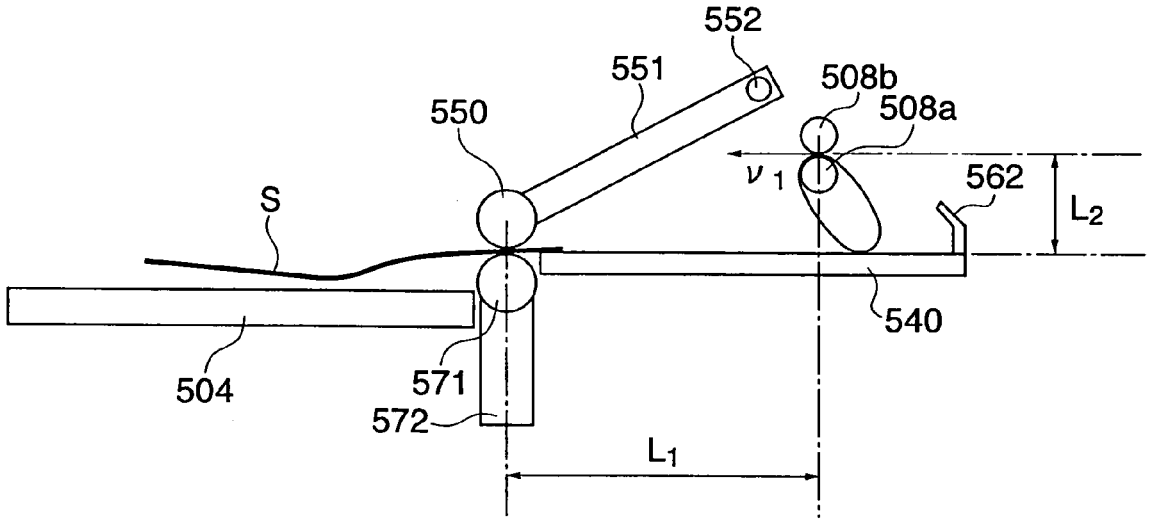
FIG. 13 is a view showing the horizontal distance and vertical distance from a nip position of a discharging section to a nip position of a swinging roller.
Figure 14:
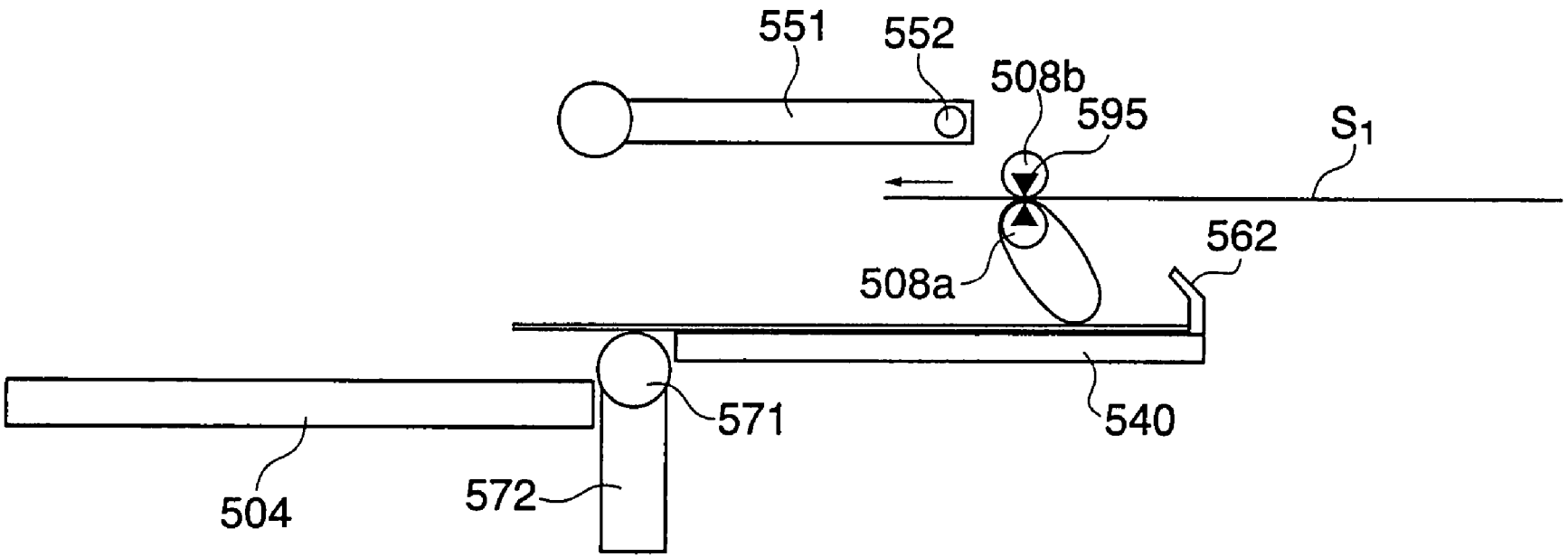
FIG. 14 is a view useful in explaining a discharging operation and a sandwiching operation for a sheet.
Figure 15:
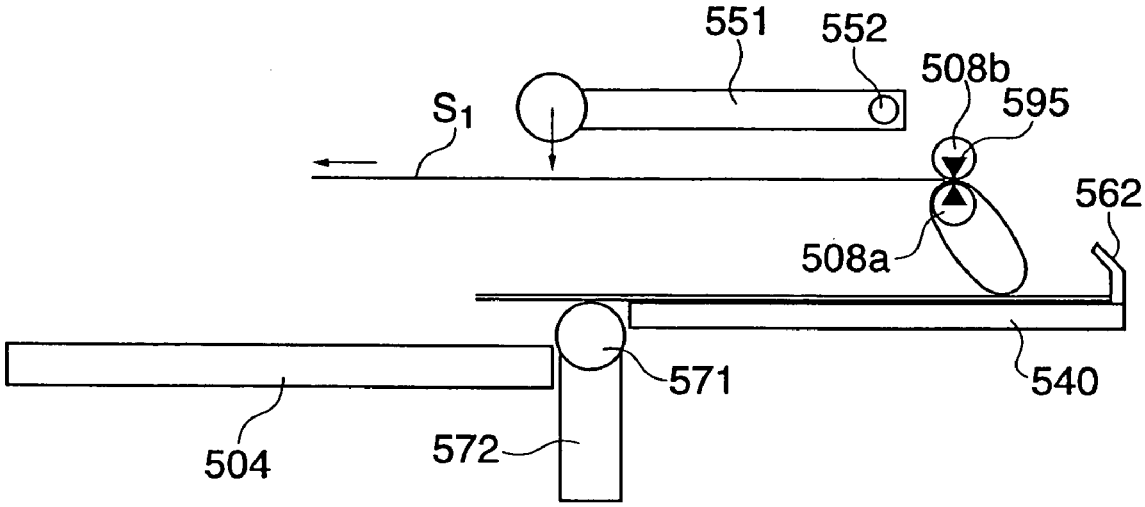
FIG. 15 is a view similar to FIG. 14.

FIG. 13 is a view showing the horizontal distance L1 and vertical distance L2 from the nip position of the discharging section 508 to the nip position of the swinging roller 550. By setting the horizontal distance L1 and vertical distance L2 from the nip position of the discharging section 508 to the nip position of the swinging roller 550 to the minimum distances that enable the sheet S to be caught by the swinging arm 551, the space occupied by the sheet processing apparatus 500 can be made small. Further, the sheet discharging motor 641 and/or the swinging arm driving motor 643 is controlled according to the space occupied by the sheet processing apparatus 500 so as for the swinging arm 551 to reliably catch the discharged sheet S.

FIGS. 14 through 22 are views useful in explaining the sheet discharging operation and the sheet sandwiching (catching) operation. Sheets discharged by the discharging roller 508*a* each have its trailing end caught by the swinging arm 551, and then are moved backward sheet by sheet until the trailing end thereof reaches the sheet trailing stopper 562. Then, when a sheet S1 which is the last sheet of a bundle of sheets discharged is conveyed by the discharging roller 508*a* (refer to FIG. 14) and a sheet detecting sensor 595 detects that the trailing end of the sheet S1 has passed the discharging roller 508*a*, a lowering motion of the swinging arm 551 is started (refer to FIG. 15). In the illustrated example, the passage of the trailing end of the sheet is detected by the sheet detecting sensor 595, but, alternatively, it may be determined that the trailing end of the sheet has passed the discharging roller 508*a* when a predetermined time period has elapsed or the sheet has been conveyed by a predetermined amount (distance) after the inlet sensor 521 detected the trailing end of the sheet, as stated before.

Figure 16:
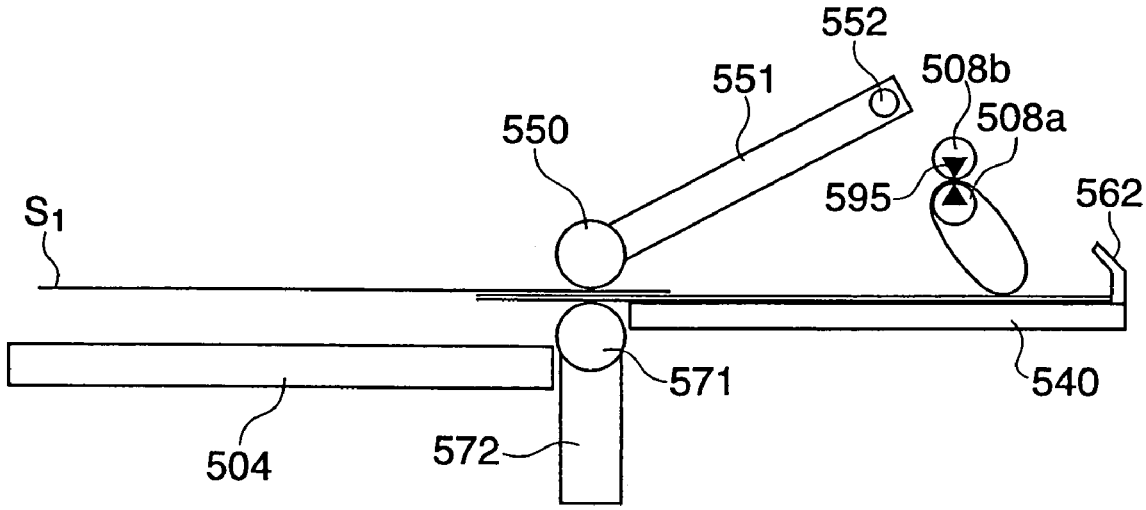
FIG. 16 is a view similar to FIG. 14.
Figure 17:
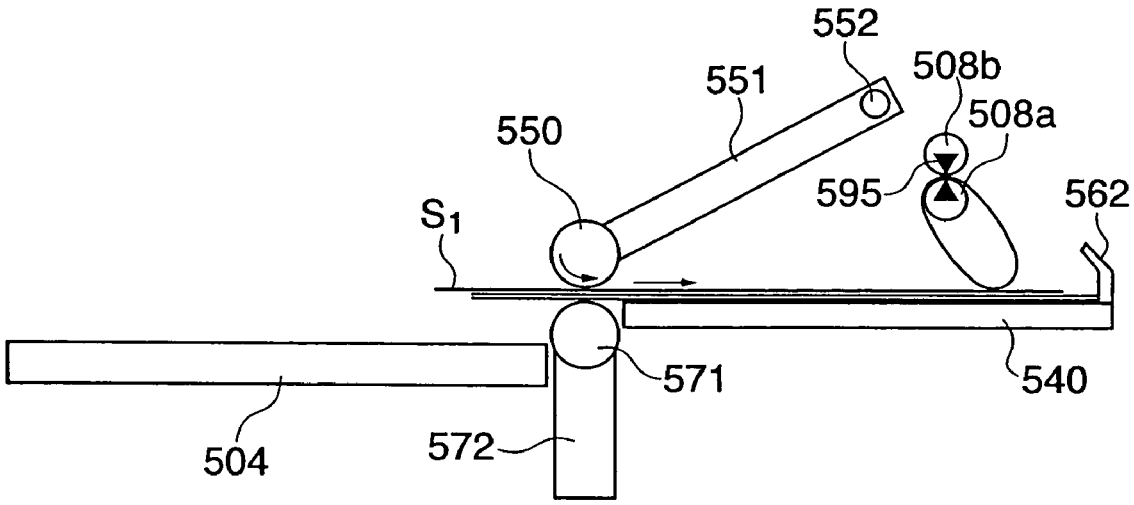
FIG. 17 is a view similar to FIG. 14.
Figure 18:
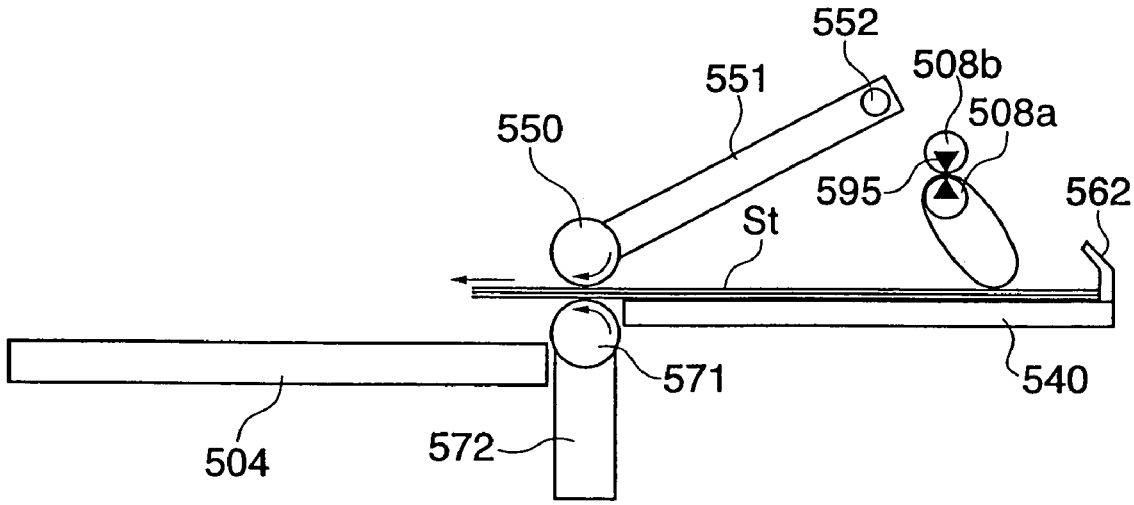
FIG. 18 is a view similar to FIG. 14.
Figure 19:
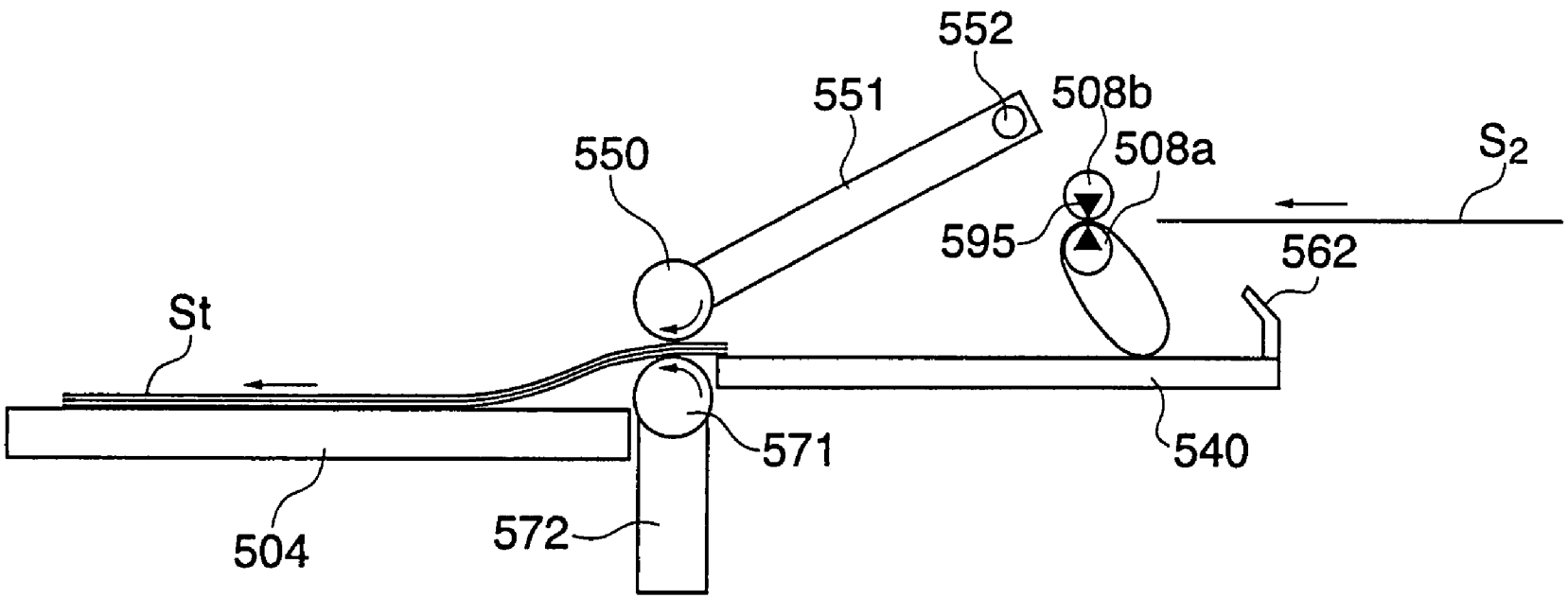
FIG. 19 is a view similar to FIG. 14.

The sheet S1 discharged onto the processing tray 540 is caught between the swinging roller 550 attached to the free end of the swinging arm 551 and the following roller 571 (refer to FIG. 16). Thereafter, the swinging roller 550 is rotated counterclockwise to move back the sheet S1 until its trailing end reaches the sheet trailing stopper 562 (refer to FIG. 17). Then, after the last sheet of the sheet group has been stacked on the processing tray 540 and predetermined processing such as sheet aligning and stapling has been carried out on the sheets stacked on the processing tray 540, the swinging roller 550 is rotated clockwise to discharge in a bundle the sheet bundle St from the processing tray 540 to the stack tray 504 (refer to FIGS. 18 and 19).

Figure 20:
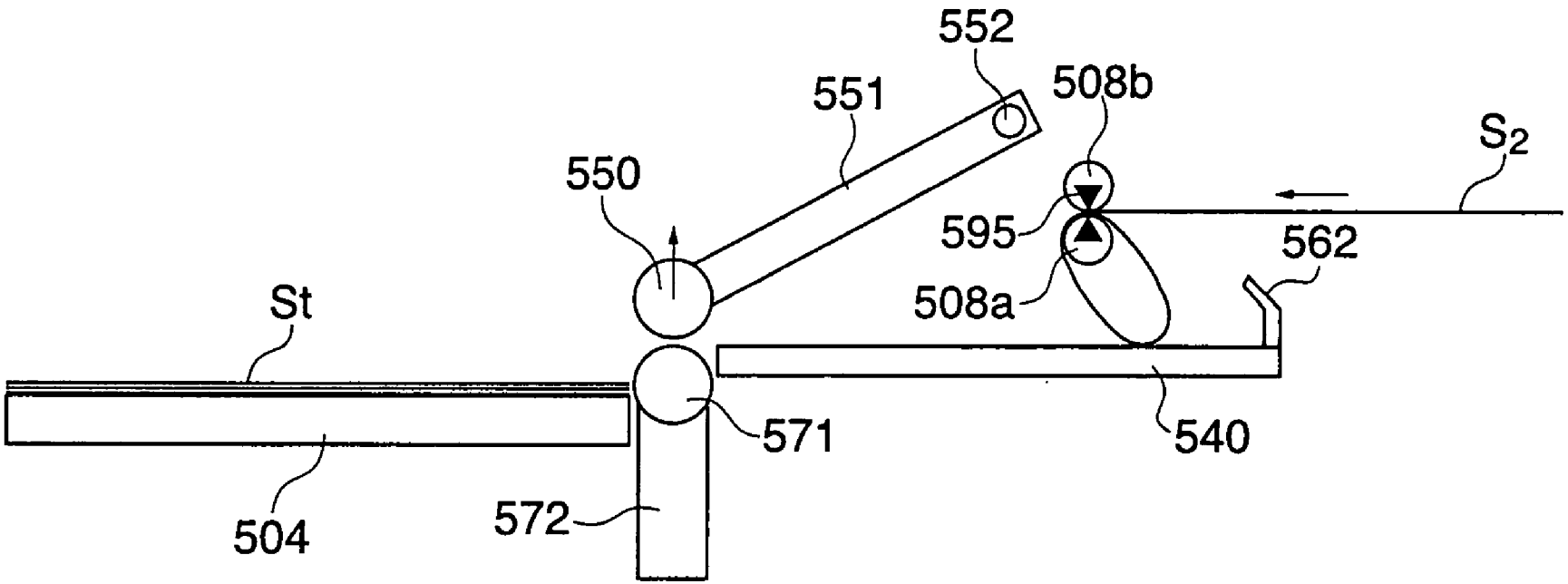
FIG. 20 is a view similar to FIG. 14.
Figure 21:
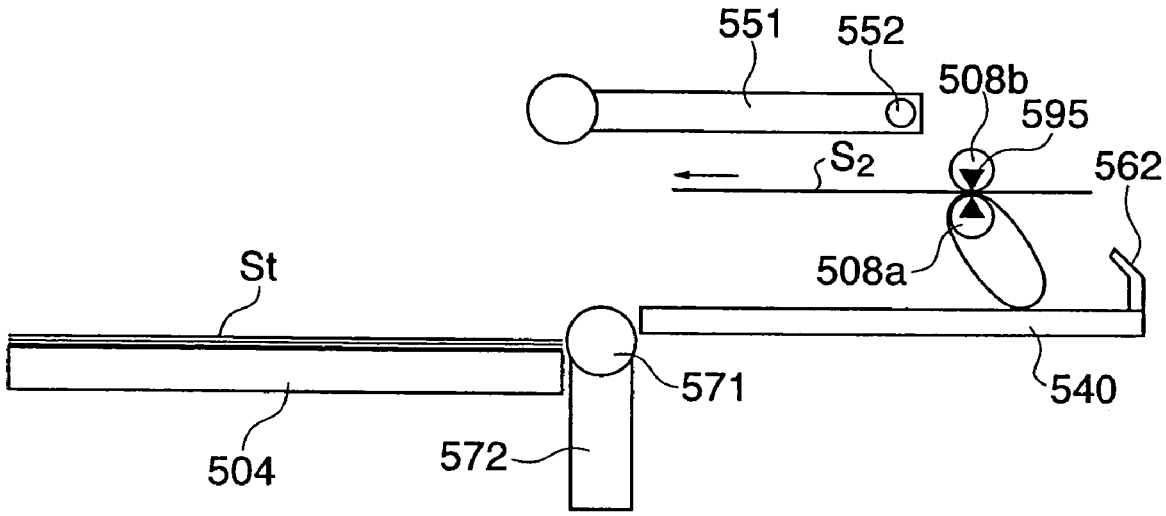
FIG. 21 is a view similar to FIG. 14.
Figure 22:
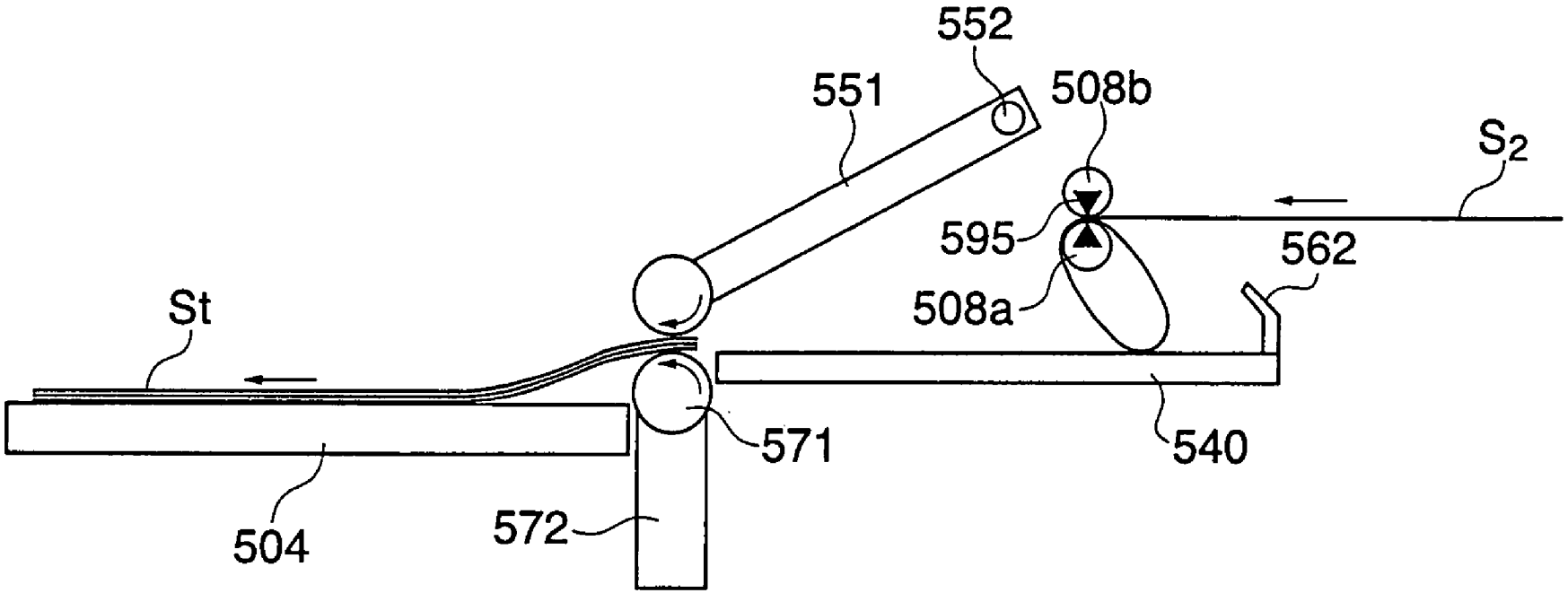
FIG. 22 is a view similar to FIG. 14.

After completion of the bundle discharge of the sheet bundle St, the swinging arm 551 is caused to start upward movement (refer to FIG. 20). The upward movement of the swinging arm 551 is carried out in such timing that the leading end of a sheet S2 which is the top sheet of a succeeding sheet bundle does not interfere with the swinging arm 551 (refer to FIG. 21).

The amount of rotation of the swinging arm 550 is set to the sum of the amount of movement in a bundle of the sheet bundle St and an amount of additional conveyance that is carried out to prevent the trailing end of the sheet bundle from being left on the following roller 571. Accordingly, during the additional conveyance following completion of the movement in a bundle of the sheet bundle St, when the leading end of the succeeding sheet S2 reaches the sheet detecting sensor 595, the swinging arm 551 is caused to start upward movement (refer to FIG. 22).

Here, conditions for the swinging arm 551 to reliably catch a discharged sheet will be explained. The trailing end of a sheet discharged from the discharging roller 508*a* constituting a part of the discharging section 508 is discharged at the discharging speed v1. Provided that the sliding time period of the sheet after its trailing end passes the nip position and until it reaches the catching position is designated by t, and the swinging lowering time period over which the swinging arm 551 is moved from its waiting position (home position) to the catching position is designated by T, if $T \leqq t$ holds, the discharged sheet can be caught by the swinging roller 550 attached to the free end of the swinging arm 551.

Figures 23, 24:
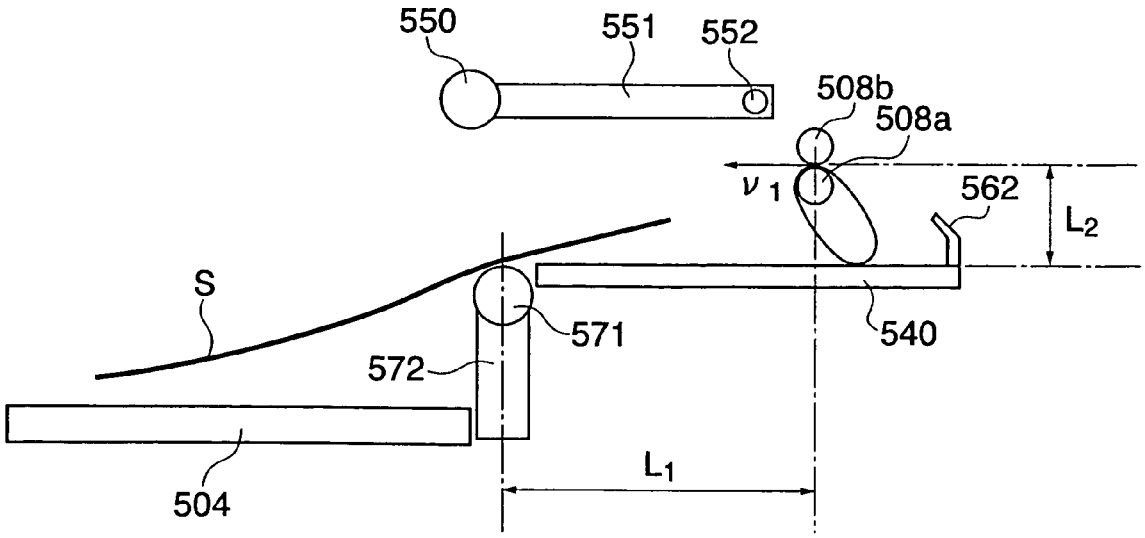
FIG. 23 is a view showing a table of various set values relating to sheet discharge and sheet sandwiching (sheet catching)
FIG. 24 is a view useful in explaining a sheet discharging operation which makes it impossible to carry out a sheet catching operation.

However, in the case where the discharged sheet is thick paper which is firm, when the thick paper is discharged from the discharging section 508, even if the discharging roller 508*a* is caused to rotate at the same rotational speed as that for a plain sheet, the discharging speed of the thick paper is likely to become higher than that of a plain sheet so that $t<T$ holds and hence the swinging arm 551 cannot catch the sheet. To avoid such inconvenience, in the present embodiment, the operating speed v of the swinging arm 551 or the operating acceleration of the same is changed according to a sheet conveying mode. FIG. 23 is a view showing a table of various set values relating to the sheet discharge and sheet catching operations.

In the case of a sheet made of a material A (e.g. plain paper), provided that the sliding time period over which the trailing end of the sheet is moved from the sheet discharging nip position to the catching position is designated by t1, the swinging lowering time period over which the swinging arm 551 is moved from the waiting position to the catching position, T1, the operating speed of the swinging arm 551, v1, and the operating acceleration of the swinging arm 551, a1, the catching operation can be performed under a condition of $t1 \leqq T1$.

By contrast, in the case of a sheet made of a material B (e.g. thick paper), if the discharging speed v of the trailing end of the sheet increases to a speed v 2 ($v1<v2$), the sliding time period t over which the trailing end of the sheet is moved from the sheet discharging nip position to the catching position decreases to a time period t2 ($t2<t1$), and therefore, when a condition of $t2<T1$ stands, the sheet catching operation cannot be performed.

Therefore, in the present embodiment, the conveying mode, described later, is determined, and if the sheet of the material B is determined to be thick paper, the driving speed v of the swinging arm 551 is increased from the speed v1 to a speed v2. By so doing, the swinging lowering time period T over which the swinging arm 551 is moved from the waiting position to the catching position become shortened to a time period T2 ($T1>T2$), and therefore, if a condition of $t2 \geqq T2$ stands, the sheet catching operation can be performed.

Likewise, by changing the driving acceleration a of the swinging arm 551 from an acceleration a1 to an acceleration a2 ($a1<a2$), the swinging lowering time period T over which the swinging arm 551 is moved from the waiting position to the catching position become shortened to the time period T2 ($T1>T2$), and therefore, if the condition of $t2 \geqq T2$ stands, the sheet catching operation can be performed.

FIG. 24 is a view useful in explaining a sheet discharging operation which makes it impossible to carry out a sheet catching operation. Even when the stack tray 504 is in a lowered position, the swinging arm 551 is controlled to reliably catch the sheet S so that the sheet S does not slip onto the stack tray 504.

Let us contemplate the case where the swinging lowering time period T over which the swinging arm 551 is moved from the waiting position to the catching position is constantly set to the time period T1. In this case, in the case of a sheet made of the material A, provided that the sliding time period t over which the trailing end of the sheet is moved from the sheet discharging nip position to the catching position is designated by t1, the swinging lowering time period T over which the swinging arm 551 is moved from the waiting position to the catching position, T1, the operating speed v of the swinging arm 551, v1, and the operating acceleration a of the swinging arm 551, a1, the sheet catching operation can be performed under the condition of $t1 \geqq T1$, as stated before.

However, in the case of a sheet made of the material B, when the discharging speed v of the trailing end of the sheet increases to the speed v2($v1<v2$), the sliding time period t over which the trailing end of the sheet is moved from the sheet discharging nip position to the catching position becomes a time period t2 ($t2<t1$), and therefore, if the condition of $t2<T1$ stands, the sheet catching operation cannot be performed.

Therefore, in the present embodiment, the sheet conveying mode, described later, is determined, and if the sheet of the material B is determined to be thick paper, the sheet catching operation by the swinging arm 551 can be performed when a sliding time period t3 calculated from the discharging speed of the trailing end of the sheet discharged by the discharging roller 508*a* and the distance L1 (refer to FIGS. 13 and 24) between the nip positions satisfies a condition of $T1 \leqq t3$ stands.

Figure 25:
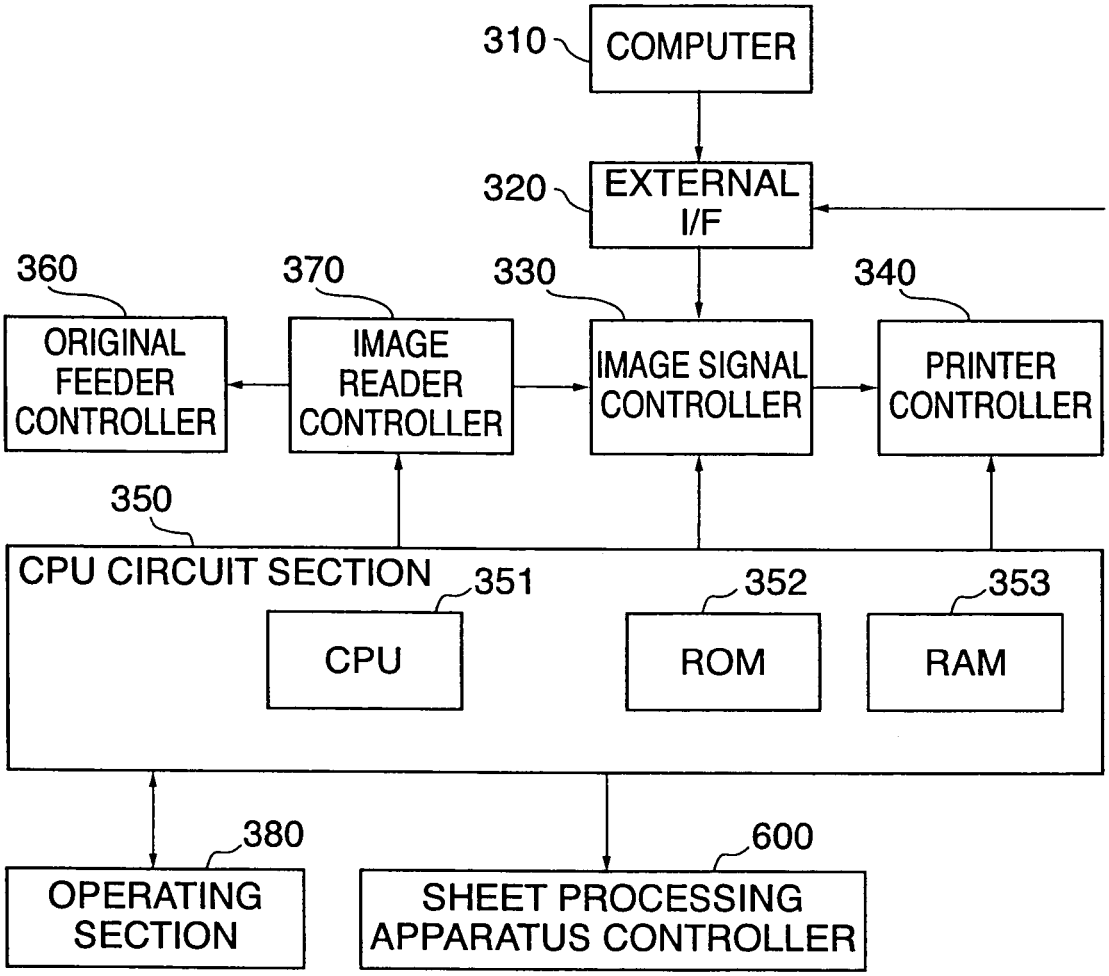
FIG. 25 is a block diagram showing the construction of a controller which controls the overall operation of the image forming apparatus.

FIG. 25 is a block diagram showing the construction of a controller which controls the overall operation of the image forming apparatus. The controller is comprised of a CPU circuit section 350, the operating section 380, a sheet processing apparatus controller 600, an original feeder controller 360, an image reader controller 370, an image signal controller 330, and a printer controller 340. An external computer 310 is connected to the image signal controller 330 via an external interface (I/F) 320.

The CPU circuit section 350 has a CPU 351, a ROM 352, and a RAM 353 incorporated therein. The CPU 351 executes control programs stored in the ROM 352 to collectively control component parts of the controller. The RAM 353 temporarily stores control data, and serves as a working area for arithmetic operations when the CPU 351 executes the control programs.

The original feeder controller 360 controls the automatic original feeder 100 in accordance with instructions from the CPU circuit section 350. The image reader controller 370 controls the scanner unit 104, the image sensor 109, and so forth, and transfers an analog image signal output from the image sensor 109 to the image signal controller 330.

The image signal controller 330 converts the analog image signal output from the image sensor 109 into a digital signal, performs various kinds of processing on the digital signal, converts the resulting digital signal into a video signal, and outputs the video signal to the printer controller 340. Also, the image signal controller 330 performs various kinds of processing on a digital image signal input from the computer 310 via the external I/F 320, converts the resulting digital image signal into a video signal, and outputs the video signal to the printer controller 340. The operation of the image signal controller 330 is controlled by the CPU circuit section 350.

The printer controller 340 drives the laser scanner unit (exposure controller) 202 according to the input video signal. The operating section 380 includes a plurality of keys for setting various functions relating to image formation, a display for displaying setting information, and so forth, and outputs a key signal corresponding to operation of each key to the CPU circuit section 350 and displays the corresponding information on the display according to the key signal from the CPU circuit section 350.

The sheet processing apparatus controller 600 is provided in the sheet processing apparatus 500, for exchanging information with the CPU circuit section 350 to control the overall operation of the sheet processing apparatus 500 as described later.

Figure 26:
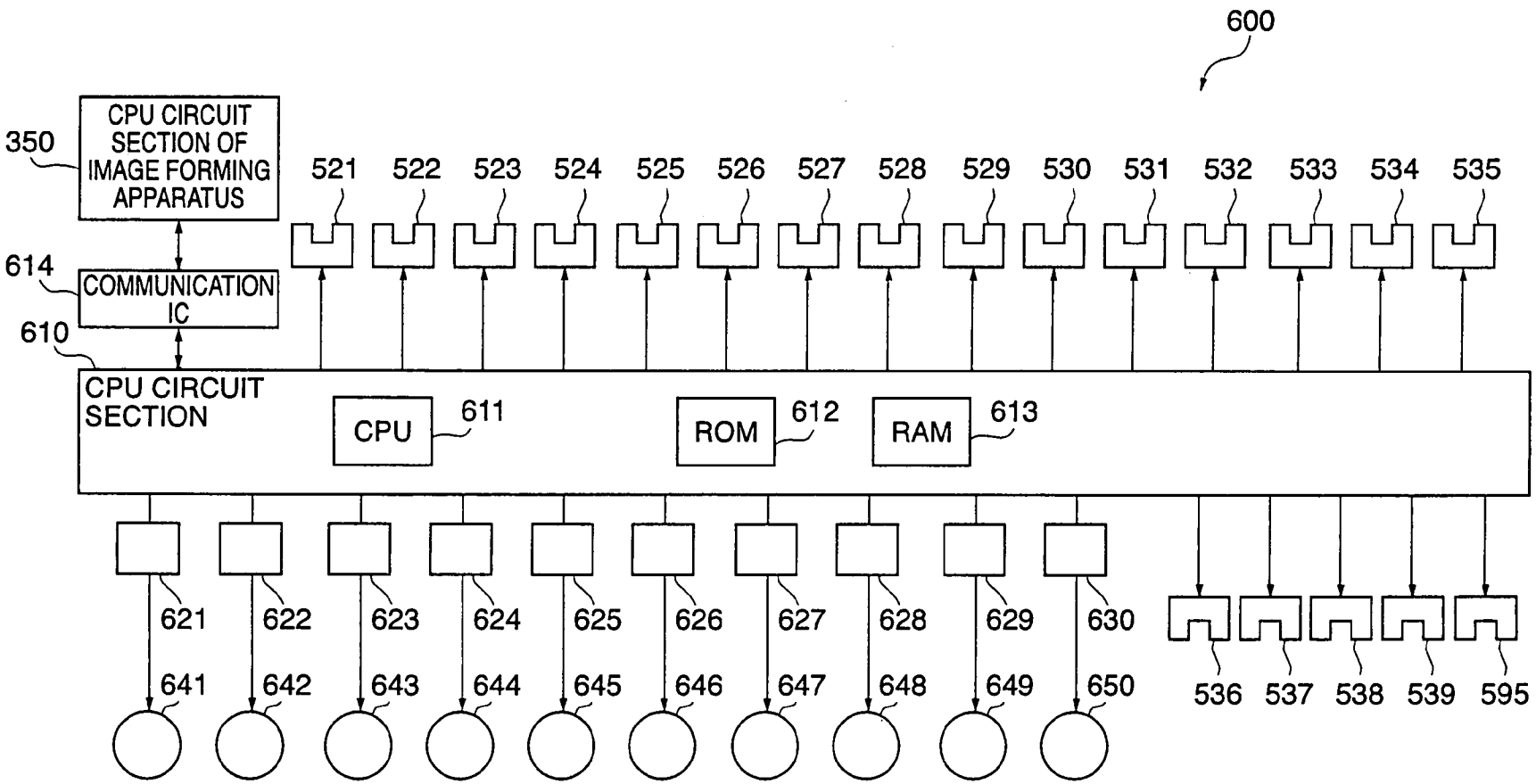
FIG. 26 is a block diagram showing a sheet processing apparatus controller of the controller in FIG. 25.

FIG. 26 is a block diagram showing the construction of the sheet processing apparatus controller 600.

The sheet processing apparatus controller 600 includes a CPU circuit section 610 to which various drivers and various sensors are connected. The CPU circuit section 610 is comprised of a CPU 611, a ROM 612, and a RAM 613. The CPU 611 executes control programs stored in the ROM 612 to control the sheet processing apparatus 500. Further, the CPU circuit section 610 communicates with the CPU circuit section 350 in the main body of the image forming apparatus via a communication IC 614 to exchange data with the same, and controls the sheet processing apparatus 500 in accordance with instructions from the CPU circuit section 350.

To control the sheet processing apparatus 500, the CPU circuit section 610 captures detection signals from various sensors. Examples of the sensors include the inlet sensor 521, a swinging home position sensor 522, a swinging pendulum, home position sensor 523, a tray detecting sensor 524, a sheet surface detecting sensor 525, a return belt moving-back sensor 526, a staple slide home position sensor 527, a staple clinch home positions sensor 528, a processing tray sheet detecting sensor 529, a front aligning home position sensor 530, a rear aligning home position sensor 531, a puddle home position sensor 532, a stack tray sheet detecting sensor 533, a stack tray encoder clock sensor 534, a sheet surface detecting upper sensor 535, a sheet surface detecting lower sensor 536, a tray upper limit sensor 537, a tray lower limit sensor 538, a front cover opening/closing detecting sensor 539, and a sheet detecting sensor 595.

Further, various motor drivers 621 to 630 are connected to the CPU circuit 610; the motor drivers 621 to 630 drive corresponding respective motors according to signals from the CPU circuit section 610. Examples of the motors include a sheet discharging motor 641, the swinging roller driving motor 642, the swinging arm driving motor 643, a trailing end aligning wall driving motor 644, a puddle motor 645, the front aligning motor 646, the rear aligning motor 647, the staple clinch motor 648, the staple slide motor 649, and a stack tray motor 650.

The sheet discharging motor 641 drives a pair of inlet conveying rollers (discharging section 508) and the discharging roller 508*a* constituting the return belt 560. The swinging roller driving motor 642 is attached to an end of the swinging arm 551, for driving the swing roller 550 which pulls back a sheet conveyed by the pair of inlet conveying rollers, and discharges a bundle of sheets processed on the processing tray 540 onto the stack tray 504. The swinging arm driving motor 643 drives the swinging arm 551 to swing vertically so as to catch the trailing end of sheets discharged onto the processing tray 540.

The rear end aligning wall driving motor 644 drives the rear end aligning wall member 570 which aligns a bundle of sheets, which has been discharged onto the stack tray 504, at the rear edge thereof. The puddle motor 645 drives the sheet returning member 583 which presses the trailing end of a bundle of sheets stacked on the stack tray 504. The front aligning motor 646 and the rear aligning motor 647 drive the front aligning plate 541 and the rear aligning plate 542 which align sheets stacked on the processing tray 540 in the direction perpendicular to the sheet conveying direction.

The staple clinch motor 648 drives the stapler unit 510 to staple sheets. The staple slide motor 649 moves the stapler unit 510 forward and backward. The stack tray motor 650 moves the stack tray 504 in a vertical direction.

Here, the sheet discharging motor 641, swinging roller driving motor 642, swinging arm driving motor 643, trailing end aligning wall driving motor 644, puddle motor 645, front aligning motor 646, rear aligning motor 647, and staple slide motor 649 are implemented by stepping motors that are each capable of rotating pairs of rollers driven by the respective motors at a constant speed or different speeds by controlling the excitation pulse rate.

Further, the sheet discharging motor 641, swinging roller driving motor 642, swinging arm driving motor 643, front aligning motor 646, rear aligning motor 647, and staple slide motor 649 are capable of being driven to rotate in forward and backward rotational directions by the sheet discharging motor driver 621, swinging roller driving motor driver 622, swinging arm driving motor driver 623, front aligning motor driver 626, rear aligning motor driver 627, and staple slide motor driver 629, respectively. The staple clinch motor 648 and the stack tray motors 650 are each implemented by a DC motor.

Figure 27:
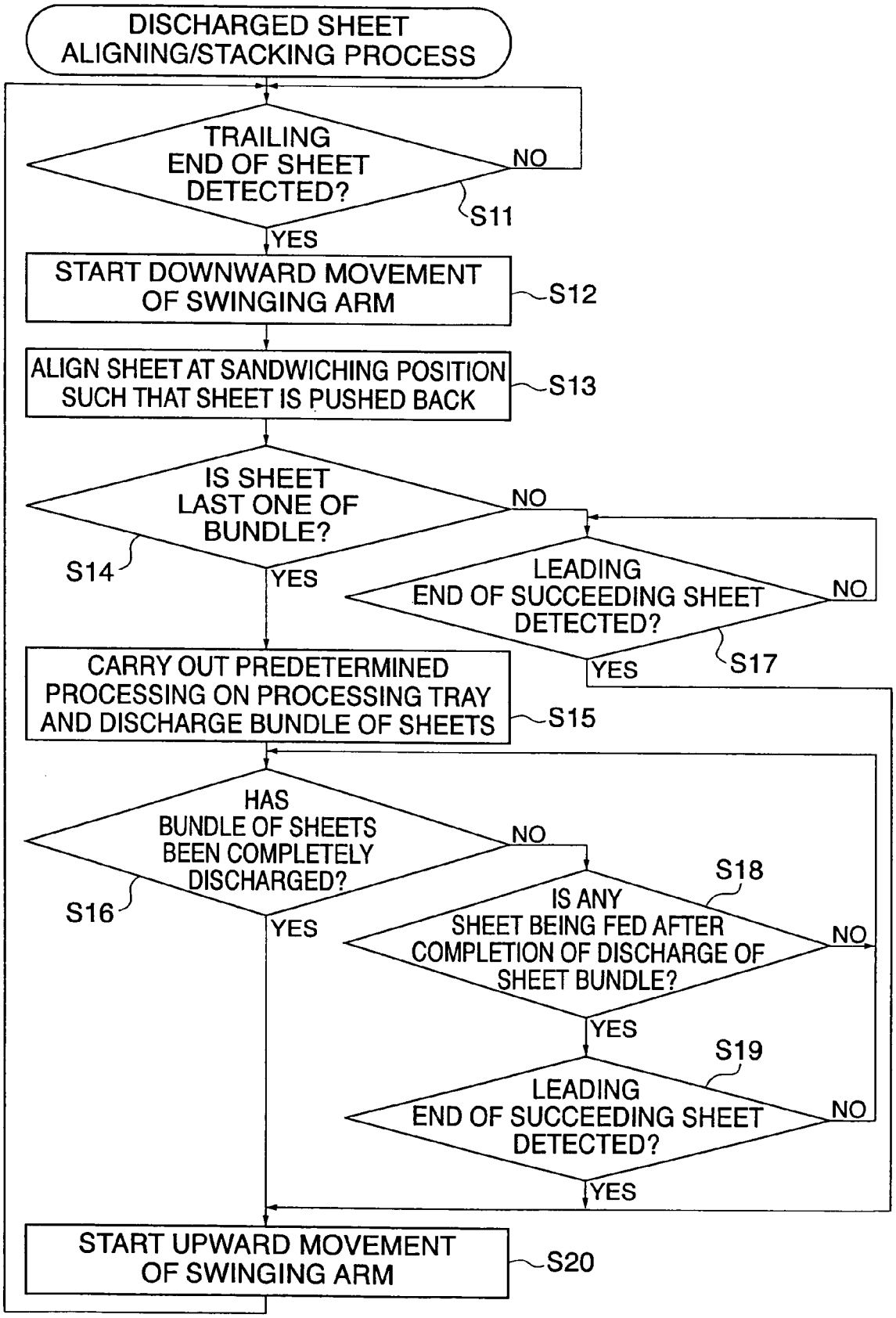
FIG. 27 is a flow chart showing a process for aligning and stacking discharged sheets.

FIG. 27 is a flow chart showing a process for aligning/stacking discharged sheets. A program for implementing the process is stored in the ROM 612 of the sheet processing apparatus controller 600, and is executed by the CPU 611.

The process waits until the trailing end of a sheet discharged by the discharging roller 508*a* at the discharging speed v is detected by the sheet detecting sensor 595 provided upstream of the discharging roller 508*a* (step S11). When the trailing end of the sheet is detected by the sheet detecting sensor 595, an operation of moving down the swinging arm 551 from a waiting position to a sandwiching position is started (step S12).

When the trailing end of the sheet discharged by the discharging roller 508*a* is sandwiched at the sandwiching position between the swinging roller 550 attached to the end of the swinging arm 551 and the following roller 571, the sheet is aligned on the processing tray 540 such that the trailing end of the sheet is pushed back to the sheet trailing end stopper 562 by counterclockwise torque from the swinging roller 550 (step S13).

It is then determined whether the aligned sheet is the last sheet of a bundle or not (step S14). If the aligned sheet is the last sheet of a bundle, predetermined processing is performed on the processing tray 540, and then the bundle of sheets is discharged by clockwise torque from the swinging roller 550 (step S15). It is determined whether the bundle of sheets has been completely discharged or not (step S16), and if the bundle of sheets has been completely discharged, an operation of moving up the swinging arm 551 from the sandwiching position to the waiting position is started (step S20). The process then returns to the step S11. The upward movement of the swinging arm 551 in the step S17 is intended to prevent the leading end of the succeeding sheet from interfering with the swinging arm 551. The timing in which the upward movement is started is determined based on a return time period required for the swinging arm 551 to return from the sandwiching position to the waiting position and a moving time period after discharge of a sheet and before the leading end of the succeeding sheet reaches the detecting position of the sheet detecting sensor 595.

On the other hand, if it is determined in the step S14 that the aligned sheet is not the last sheet of a bundle, it is determined whether the leading end of the succeeding sheet discharged by the discharging roller 508*a* has been detected by the sheet detecting sensor 595 or not (step S17). If the leading end of the succeeding sheet has not been detected, the processing of the step S17 is repeated until the leading end of the succeeding sheet is detected. If the leading end of the succeeding sheet is detected, the process proceeds to the step S20 to start the upward movement of the swinging arm 551.

On the other hand, if it is determined in the step S16 that the bundle of sheets has not been completely discharged, it is determined in a step S18 whether the sheet is being fed after completion of the discharge of the bundle of sheets or not. If the sheet is being fed, it is determined whether the leading end of the succeeding sheet has been detected by the sheet detecting sensor 595 or not (step S19). If the leading end of the succeeding sheet has been detected, the process proceeds to the step S20 to start the upward movement of the swinging arm 551.

On the other hand, if the sheet is not being fed after completion of the discharge of the bundle of sheets in the step S18 or if the leading end of the succeeding sheet has not been detected in the step S19, the process returns to the step S16, wherein the swinging arm 551 is caused to wait at the sandwiching position until the discharge of the sheet bundle is completed.

Figure 28:
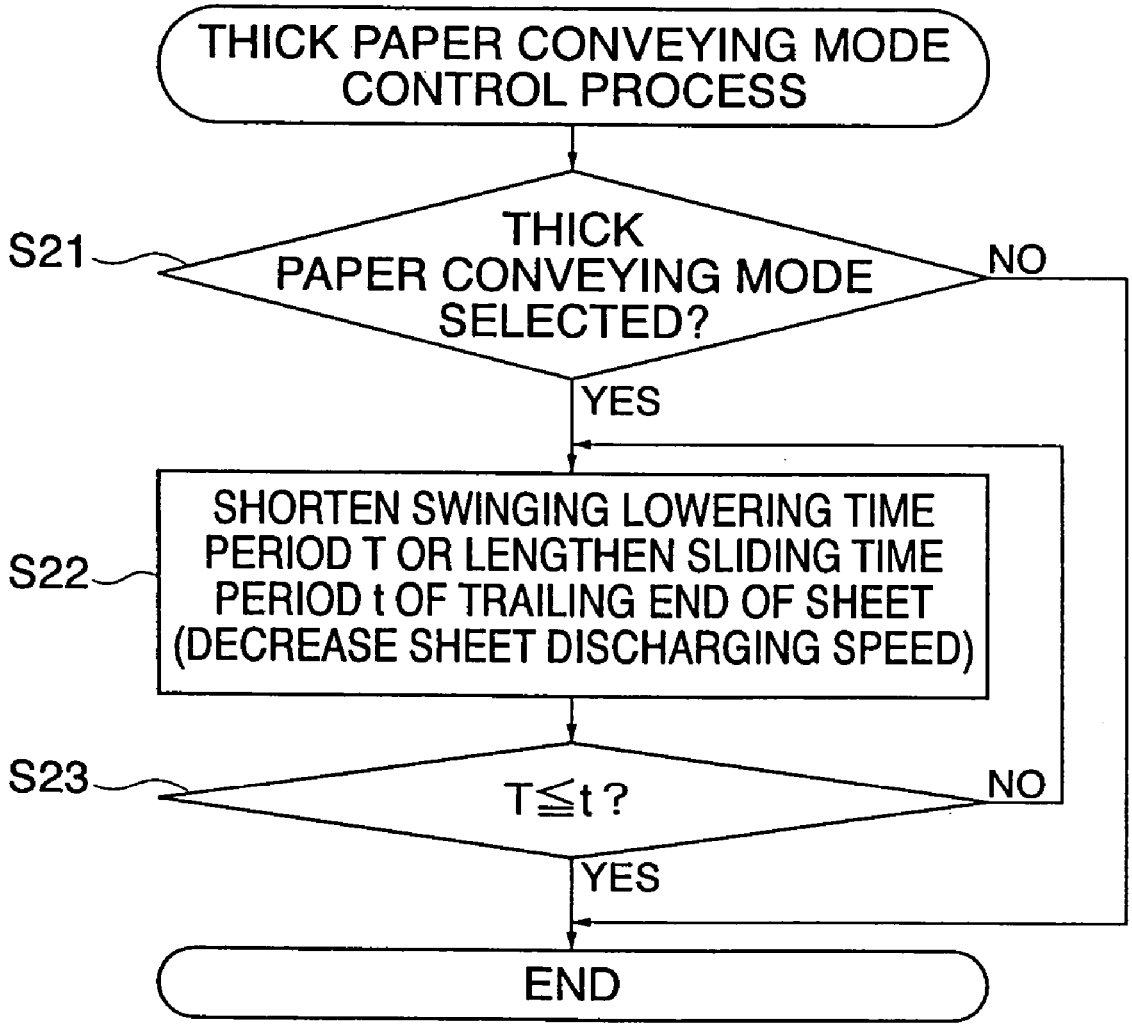
FIG. 28 is a flow chart showing a control process in a thick paper conveying mode.
Figure 29:
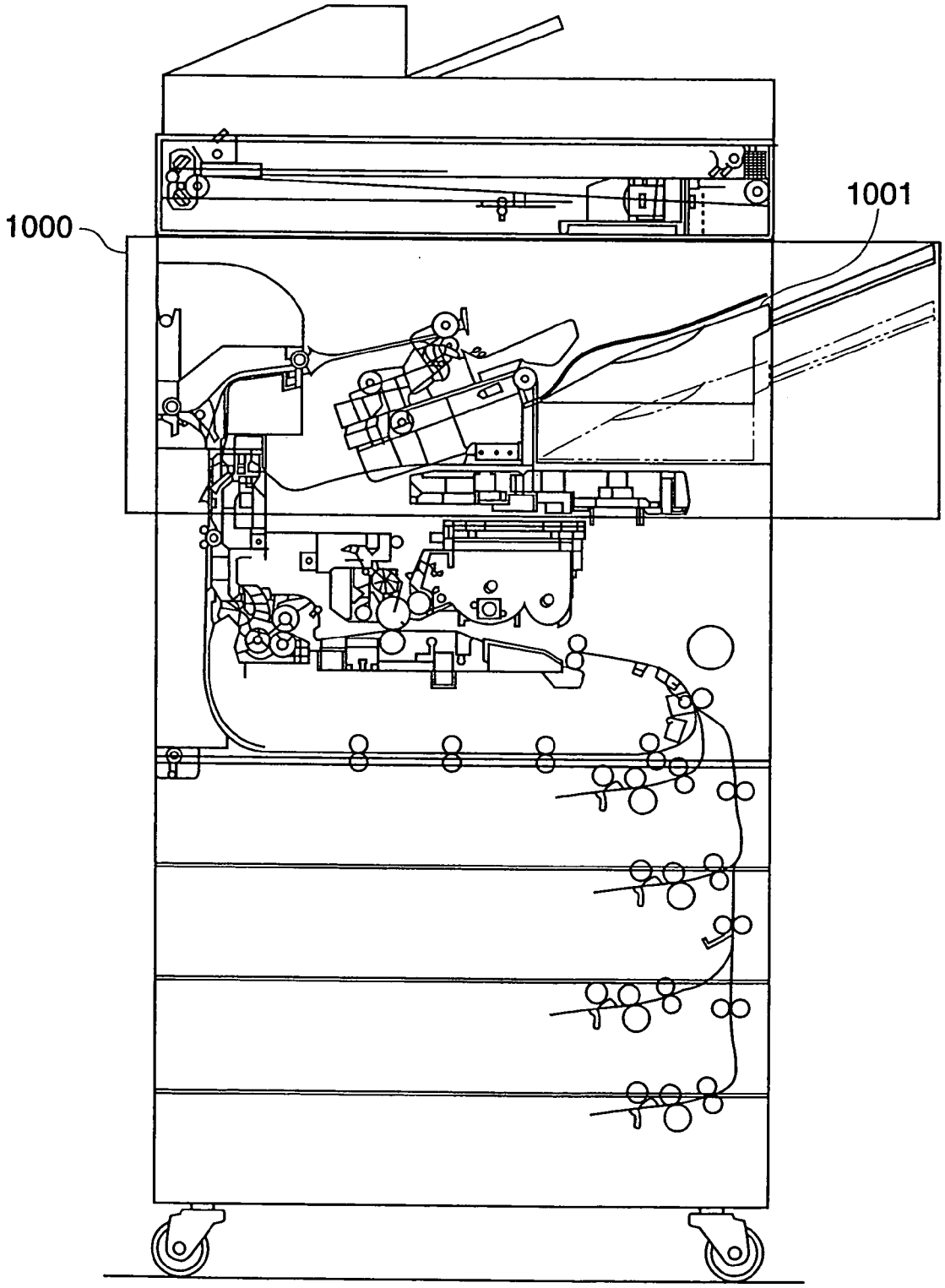
FIG. 29 PRIOR ART
FIG. 29 is a sectional view showing the construction of a conventional image forming apparatus of a type in which sheets are discharged inside a housing thereof.

FIG. 28 is a flow chart showing a control process in a thick paper conveying mode. A program for implementing this process is stored in the ROM 612 in the sheet processing apparatus controller 600 (FIG. 13), and is executed by the CPU 611 before the sheet discharging operation is carried out. First, it is determined whether the thick paper conveying mode has been selected via the operating section 380 or not (step S21). It should be noted that, instead of checking the sheet conveying mode selected through the operation of an operator, a sensor for detecting the material of the sheet to be processed or the like may be provided so that the sheet conveying mode is checked based on detection information from the sensor to determine whether the thick paper conveying mode has been selected or not.

If it is determined that the thick paper conveying mode has been selected, the operation of the swinging arm 551 or the discharging roller 508*a* is controlled such that the swinging lowering time period T over which the swinging arm 551 is moved from the waiting position to the catching position becomes shorter or the sliding time period t of the trailing end of the sheet discharged by the discharging roller 508*a* becomes longer (step S22). After this, it is determined whether the relationship between the swinging lowering time period T and the sliding time period t satisfies the condition of $T \leqq t$ or not (step S23). If the condition of $T \leqq t$ is satisfied, the present process is terminated. On the other hand, if the condition of $T \leqq t$ is not satisfied, the process returns to the step S22 to repeat the above processing.

Here, the swinging lowering time period T in the step S22 can be shortened by increasing the operating speed or operating acceleration of the swinging arm 551, but the operating speed or the operating acceleration is controlled such that the swinging arm 551 does not bound at the catching position. Further, the sliding time period t of the trailing end of the sheet in the step S22 can be lengthened by decreasing the discharging speed of the trailing end of the sheet from the discharging roller 508*a*, but the discharging speed is controlled such that the trailing end of the sheet does not stay at the discharging roller 508*a*. Moreover, the sliding time period t of the sheet trailing end is calculated from the sheet discharging speed and the distance L1 between the nips, but if $T \geqq t$ holds in the step S23, the sheet catching operation cannot be performed, and therefore the control in the step S22 is carried out again so as to satisfy $T \leqq t$.

According to the present embodiment, the catching operation of sheets by the swinging arm can be reliably performed. Therefore, it is possible to prevent a sheet discharged from the discharging section from jumping and hence ensure positive backward movement of the sheet. Further, during the sheet catching operation, the upward movement of the swinging arm can be controlled so as not to hinder the conveyance of the succeeding sheet. As a result, sheets can be conveyed without a delay in entrance of the succeeding sheet to the sheet processing apparatus, and the sheet discharging operation of the discharging section can be ensured. Moreover, reliable catching of sheets by the swinging arm makes it possible to reduce the size of the processing tray in the sheet conveying direction. In addition, the horizontal disposition of the processing tray makes it possible to increase the number of sheets that can be stacked on the processing tray, contributing to designing the sheet processing apparatus compact in size.

It should be understood that the present invention is not limited to the embodiment described above, but various changes in or to the above described embodiment may be possible without departing from the spirits of the present invention, including changes as described below.

For example, in the above described embodiment, when the thick paper conveying mode is selected, the swinging lowering time period over which the swinging arm is moved from the waiting position to the catching position is shortened to thereby ensure reliable catching of sheets by the swinging arm. However, instead of shortening the swinging lowering time period, the lowering start timing of the swinging arm may be advanced.

Further, although in the above described embodiment, the case where the sheets to be processed is thick paper is illustrated, the swinging operation of the swinging arm and/or the sheet discharging operation of the discharging section may be controlled according to sheet conditions such as sheet weight, sheet size, and whether the sheets to be processed have black-and-white images or color images formed thereon.

Furthermore, in the above described embodiment, a sheet S discharged by the discharging roller 508*a* is first caught by the swinging arm 550 and the following roller 571 and then caused to abut on the sheet trailing stopper 565 by rotating the swinging roller 550 counterclockwise. However, when neither the stapling mode nor the sort mode is selected, that is, a non-sort mode is selected, it may be configured such that the sheet S discharged by the discharging roller 508*a* is first caught by the swinging roller 550 and the following roller 571 and then discharged onto the stack tray 504 by rotating the swinging roller 550 clockwise. According to this alternative configuration, the return or backward moving operation for the sheet S on the processing tray 540 is not necessary, whereby the discharging processing time period can be shortened, and besides, since the operation of discharging the sheet S onto the stack tray 504 is carried out after catching of the sheet S by the swinging roller 550 and the following roller 571, sheets S discharged onto the stack tray 504 can be prevented from being scattered.

What is claimed is:

1. A sheet stacking apparatus comprising:

a first sheet stacking device that stacks sheets;

a first discharging device that discharges a sheet conveyed from an upstream side thereof toward said first sheet stacking device;

a second sheet stacking device provided downstream of said first sheet stacking device, wherein a leading end of a sheet laid on said second sheet stacking device is lower in level than a highest portion of a trailing end thereof laid on said first sheet stacking device when the trailing end of the sheet is discharged from said first discharging device;

a second discharging device that discharges the sheets stacked on said first sheet stacking device to said second sheet stacking device, said second discharging device being capable of selectively assuming a catching state in which a sheet discharged to said first sheet stacking device is caught by said second discharging device, and a non-catching state in which a sheet discharged to said first sheet stacking device is not caught by said second discharging device;

a pivotal aligning wall member that aligns the trailing ends of the sheets stacked on the second sheet stacking device; and a controller that controls said second discharging device to assume the non-catching state when said first discharging device starts discharging a sheet, and to switch to the catching state before a trailing end of the sheet discharged by said first discharging device passes said second discharging device.

2. A sheet stacking apparatus as claimed in claim 1, wherein said controller provides control to change at least one selected from the group consisting of a discharging speed of said first discharging device, swinging start timing of said second discharging device, a swinging speed of said second discharging device, and a swinging acceleration of said second discharging device.

3. A sheet stacking apparatus as claimed in claim 1, wherein said second discharging device is swingable between a waiting position in which said second discharging device does not interfere with a sheet discharged by said first discharging device, and a catching position in which said second discharging device can catch the sheet discharged by said first discharging device.

4. A sheet stacking apparatus as claimed in claim 3, wherein said controller comprises a comparison device that compares a swinging time period over which said second discharging device swings from the waiting position to the catching position and a sliding time period of a trailing end of a sheet discharged by said first discharging device calculated from a distance between a discharging position of said first discharging device and the catching position and a discharging speed of the sheet discharged by said first discharging device, and wherein said controller controls the swinging time period to a time period not more than the sliding time period.

5. A sheet stacking apparatus as claimed in claim 4, wherein said controller comprises a determination device that determines at least one condition of the conveyed sheet, and wherein, when said determination device determines that the conveyed sheet is thick paper, said controller carries out one of control to decrease the swinging time period or control to increase the sliding time period.

6. A sheet stacking apparatus as claimed in claim 3, wherein said controller causes said second discharging device to return to the waiting position in timing in which a trailing end of a second sheet following a first sheet discharged by said second discharging device does not interfere with said second discharging device, based on a return time period over which said second discharging device is returned from the catching position to the waiting position and a moving time period over which the trailing end of the second sheet is moved to a predetermined location after the first sheet is discharged by said second discharging device.

7. A sheet stacking apparatus as claimed in claim 6, comprising a detection device provided upstream of said first discharging device, for detecting the trailing end of the second sheet, and wherein said controller causes said second discharging device to start returning to the waiting position when a bundle of sheets stacked on said first sheet stacking device is discharged in a bundle by said second discharging device or when the trailing end of the second sheet is detected by said detection device.

* * * * *